US007497987B2

(12) United States Patent
Yamashita et al.

(10) Patent No.: US 7,497,987 B2
(45) Date of Patent: Mar. 3, 2009

(54) REFINING METHOD AND REFINING APPARATUS FOR CHROMIUM-CONTAINED MOLTEN STEEL

(75) Inventors: Kosuke Yamashita, Futtsu (JP); Ryuji Nakao, Hikari (JP); Tomoaki Tanaka, Hikari (JP); Masao Igarashi, Hikari (JP); Koichiro Yoshino, Hikari (JP); Makoto Sumi, Kitakyushu (JP)

(73) Assignees: Nippon Steel Corporation, Tokyo (JP); Nittetsu Plant Designing Corporation, Fukuoka (JP)

( * ) Notice: Subject to any disclaimer, the term of this patent is extended or adjusted under 35 U.S.C. 154(b) by 14 days.

(21) Appl. No.: 11/712,778

(22) Filed: Feb. 28, 2007

(65) Prior Publication Data

US 2007/0152386 A1 Jul. 5, 2007

Related U.S. Application Data

(62) Division of application No. 10/490,459, filed as application No. PCT/JP02/09701 on Sep. 20, 2002, now abandoned.

(30) Foreign Application Priority Data

| | | |
|---|---|---|
| Sep. 20, 2001 | (JP) | 2001-286694 |
| Sep. 20, 2001 | (JP) | 2001-286695 |
| Nov. 5, 2001 | (JP) | 2001-339046 |
| Dec. 25, 2001 | (JP) | 2001-391274 |
| Aug. 13, 2002 | (JP) | 2002-235726 |

(51) Int. Cl.
*C21C 7/10* (2006.01)

(52) U.S. Cl. ..... 266/207; 266/161

(58) Field of Classification Search ..... 266/149, 266/161, 207, 208
See application file for complete search history.

(56) References Cited

U.S. PATENT DOCUMENTS 4,604,137 A * 8/1986 Yamada ..... 266/94

FOREIGN PATENT DOCUMENTS

| | | |
|---|---|---|
| DE | 44 05 198 | 9/1995 |
| EP | 0 393 391 | 10/1990 |
| EP | 0 688 877 | 12/1995 |
| JP | 3-211216 A | 9/1991 |

(Continued)

OTHER PUBLICATIONS

Supplementary European Search Report dated May 28, 2008 issued in corresponding European Patent Application No.: 02 79 9368.

*Primary Examiner*—Scott Kastler
(74) *Attorney, Agent, or Firm*—Kenyon & Kenyon LLP

(57) ABSTRACT

A refining method and apparatus for decarburization refining of chromium containing molten steel in a vessel having a first step of blowing oxygen while the inside of the vessel is at a pressure of between 400 Torr and atmospheric pressure, a second step of blowing oxygen while evacuation the inside of the vessel to 250 to 400 Torr and a third step of blowing gas while evacuating the vessel to not more than 250 Torr. Further, a refining method and apparatus for ultra-low carbon chrome melt by performing a first vacuum refining until the third step, then restoring the pressure in the vessel to at least 400 Torr, then performing second vacuum refining while making the bottom blowing gas blow rate at least 0.4 $Nm^3$ per to steel.

12 Claims, 9 Drawing Sheets

FOREIGN PATENT DOCUMENTS

| | | |
|---|---|---|
| JP | 06-330141 | 11/1994 |
| JP | 6330143 | 11/1994 |
| JP | 8-73924 A | 3/1996 |
| JP | 8 283827 | 10/1996 |
| JP | 9287016 | 11/1997 |
| JP | 10-1716 A | 1/1998 |

* cited by examiner

FIGURES INSIDE PARENTHESES ARE kPa

REFINING METHOD AND REFINING APPARATUS FOR CHROMIUM-CONTAINED MOLTEN STEEL

This application is a divisional application under 35 U.S.C. §120 and 35 U.S.C. §121 of prior application Ser. No. 10/490,459 filed Mar. 22, 2004 now abandoned which is a 35 U.S.C. §371 of International Application No. PCT/JP02/09701 filed Sep. 20, 2002, wherein PCT/JP02/09701 was filed and published in the Japanese language.

TECHNICAL FIELD

The present invention relates to a refining method and refining apparatus for chromium-contained molten steel which refine chromium-contained molten steel in a refining vessel while blowing a gas containing oxygen gas.

BACKGROUND ART

When refining chromium steel, in particular stainless steel and other chromium steel including at least 9% of chrome, the method of decarburization refining by the AOD method of blowing oxygen gas or a mixed gas of oxygen gas and an inert gas into a melt contained in a refining vessel has been extensively used. In the AOD method, when the decarburization proceeds and the concentration of carbon in the melt drops, the chromium becomes oxidized more easily, so the method has been adopted of raising the ratio of the argon gas or other inert gas in the blown gas along with the drop in the concentration of carbon to suppress the oxidation of chromium. However, in the region of low concentration of carbon, the decarburization rate falls, so a long time is required until reaching the desired concentration of carbon. Further, to raise the ratio of the inert gas in the blown gas, the amount of consumption of the expensive inert gas greatly increases. This is also not advantageous economically.

As a method for promoting the decarburization in the region of low concentration of carbon, utilization of the vacuum refining method may be mentioned. Japanese Unexamined Patent Publication (Kokai) No. 6-287629 discloses the method of supplying oxygen gas or a mixed gas of oxygen gas and inert gas as the blown gas, decarburizing the melt until the concentration of carbon in the melt falls to 0.5 wt %, evacuating in the vessel to not more than 200 Torr (26 kPa), and continuing to decarburize the melt after the concentration of carbon falls below this value. Since performing this treatment under a vacuum from a relative high concentration of carbon and performing the decarburization by a mixed gas with oxygen gas under a vacuum, the oxygen efficiency for decarburization is improved, so the decarburization rate is improved with the same amount of supply of oxygen, the reduction silicon prime units and expensive inert gas prime units can be reduced, and the refining time can be shortened. The pressure inside the vessel in the vacuum treatment is made not more than 200 Torr (26 kPa) because it is considered that the oxygen efficiency for decarburization falls at a pressure higher than that.

Japanese Unexamined Patent Publication (Kokai) No. 9-71809 as well discloses a refining method comprising decarburizing a melt by blowing a gas containing oxygen gas in the atmosphere, then switching from atmospheric treatment to vacuum treatment at the stage when the concentration of carbon drops to 0.7 to 0.05 wt % and blowing a gas containing oxygen gas under a vacuum of 200 (26 kPa) to 15 Torr (2 kPa). The vacuum condition is made not more than 200 Torr (26 kPa) because it is considered the vacuum treatment cannot be effectively performed under a pressure higher than this.

By performing the vacuum treatment in a carbon concentration region of a concentration of carbon of not more than 0.5 wt % or a concentration of carbon of not more than 0.7 wt % and blowing gas containing oxygen gas in the vacuum treatment, it is possible to realize an improvement of the decarburization rate and a reduction of use of the expensive insert gas, but if it were possible to achieve a much shorter refining time or reduced amount of use of inert gas, this would contribute greatly to the reduction of the production costs and improvement of the productivity.

On the other hand, it is extremely difficult to refine ultra-low carbon chromium steel with a concentration of carbon of not more than 0.01% by the AOD method. As the method for promoting decarburization in such a region of low concentration of carbon, utilization of the vacuum refining method may be mentioned. As the utilization of the vacuum refining method, the VOD method of vacuum refining by decarburization in a converter until a suitable concentration of carbon, then shifting the melt to a vacuum refining vessel and the method of using a vacuum AOD furnace for vacuum refining while placing an exhaust hood over the AOD furnace are general.

As an example of the VOD method, Japanese Unexamined Patent Publication (Kokai) No. 51-142410 discloses the method of oxygen refining in a converter, then decarburizing the melt in a vacuum decarburization ladle to make the concentration of carbon after vacuum treatment 0.008%.

As a method using a vacuum AOD furnace, Japanese Examined Patent Publication (Kokoku) No. 60-10087 discloses the method of refining chromium steel by first refining by oxygen gas at the initial ordinary temperature until the carbon falls to about 0.2 to 0.4 wt %, then stopping the supply of oxygen gas while continuing to agitate the melt by the inert gas in the same vessel, continuously lowering the pressure inside the vessel to about 10 Torr (1.3 kPa), and lowering the concentration of carbon after vacuum treatment to 0.13 wt %.

With the above method, the carburization under vacuum uses only inert gas, so the oxidation of chromium is suppressed, but the oxygen source of the decarburization becomes the oxygen in the melt or the oxygen in the slag and the rate of supply of oxygen becomes slow, so a drop in the decarburization rate is invited. Therefore this cannot be said to be an efficient decarburization refining method. As opposed to this, Japanese Unexamined Patent Publication (Kokai) No. 6-287629 discloses a decarburization refining method for chromium-contained molten steel comprising supply a mixed gas of oxygen gas and inert gas as the blown gas, performing decarburization refining under atmospheric pressure until the concentration of carbon in the melt falls to 0.5 wt %, then, after the concentration of carbon falls below this value, evacuating the inside of the vessel to not more than 200 Torr (26 kPa) and continuing to decarburize the melt. In this method, gas including oxygen gas is supplied even in the vacuum refining. Due to this, the oxygen efficiency for decarburization is improved, so an improvement in the decarburization rate is achieved and the refining time can be shortened, so it is possible to achieve a large reduction in the refining costs and improvement in the productivity and refining down to the ultra-low carbon region of a concentration of carbon of not more than 0.01 wt % becomes easy. In this invention, the total amount of the blown gas during the vacuum annealing is made 0.3 $Nm^3/min \cdot T$.

In decarburization refining of ultra-low carbon chromium-contained molten steel, by applying vacuum refining to the decarburization in the low carbon concentration region and using a gas containing oxygen gas as the bottom blown gas used at the time of vacuum refining, refining of the ultra-low carbon area of a concentration of carbon of not more than 0.01 wt % becomes possible, but the decarburization rate gradually falls along with the fall in the concentration of carbon, so to decarburize the melt until this ultra-low carbon region, an extremely long refining time is required compared with decarburization refining down to the ordinary low carbon region. Therefore, compared with usual refining of low carbon chromium steel, a drop in productivity of the decarburization refining is invited and an increase in the refining costs is caused.

Further, regarding the refining apparatus for a chromium-contained molten steel, vacuum refining furnaces comes in various types such as VOD, AOD, RH, and REDA, but vacuum exhaust equipment is required for evacuating the inside of the furnace. The vacuum exhaust equipment for industrially evacuating the inside of a vacuum refining furnace generally achieves a predetermined degree of vacuum inside the furnace by combining a large number of ejectors. The degree of vacuum is controlled in accordance with the progress in refining in the vacuum refining furnace, but normally one or more ejectors with capacities commensurate with the targeted degree of vacuum are operated among a large number of ejectors to secure the predetermined degree of vacuum.

On the other hand, one type of vacuum exhaust unit used industrially is a water-sealed vacuum pump. When using this alone, due to the problem of cavitation, the attainable degree of vacuum is about 61 Torr (8 kPa). To obtain a higher degree of vacuum, it is necessary to jointly use the above-mentioned ejectors.

When controlling the degree of vacuum using only ejectors, nitrogen, air, etc. is blown in before the ejectors and the blow rate is controlled so as to control the degree of vacuum in the furnace or the ducts.

When refining a melt using gaseous oxygen under vacuum, the CO gas produced by the decarburization reaction causes the metal and slag to splash from the surface of the melt toward the top of the vacuum refining furnace. The amount of this generated increases sharply when the degree of vacuum rises (when a high vacuum is reached) and deposits on the alloy addition port, furnace cover, ducts, etc. at the top of the refining vessel to block the same or cause trouble in various equipment and operations and obstruct productivity. If raising the degree of vacuum and increasing the oxygen blow rate, a rapid decarburization reaction will proceed and the phenomenon will arise of the CO gas generated causing a large amount of metal to be blown upward all at once from near the surface of the melt, that is, boiling will be caused. This will also become major trouble in the equipment and worsen the productivity.

In this way, vacuum oxygen decarburization of a carbon melt is an operation which requires extreme care. The point is to control the degree of vacuum and the oxygen blow rate in accordance with the concentration of carbon in the melt. Among these, the oxygen blow rate can be controlled to a certain extent by the flow adjustment valve of the oxygen gas, but no sufficient control method has been established for the degree of vacuum.

In the above prior art, when using ejectors, the method of successively starting and stopping a large number of ejectors does not allow extremely fine control of the degree of vacuum since the ranges of capacity of the ejectors themselves are broad. Further, as seen in Japanese Unexamined Patent Publication (Kokai) No. 10-1716, the method of allowing gas to leak in from the outside while operating the exhaust unit (for example, using nitrogen) enables control of the degree of vacuum to a certain extent, but has the defect that the gas costs rise. As a means for slashing the gas costs, there is the method of using air as an alternative to nitrogen. However, while control of the degree of vacuum itself is possible, the exhaust gas sucked in contains a high concentration of CO gas, so when mixing in air containing a combustion-assisting gas constituted by oxygen, there is the danger of combustion and explosion. Employment for actual machinery is extremely dangerous. Further, if allowing gas to leak in from the outside, the load on the exhaust unit increases. For example, the power used by the vacuum pump increases. Therefore, this is not preferable from the viewpoint of energy conservation. Further, the method of controlling the amount of supply of steam to an ejector used in this patent relies on the fact that the optimum steam flow rate of an ejector is distinctive, so changing this remarkably reduces the exhaust performance of the ejector itself. Further, at the same time, a slight fluctuation in the amount of steam is overly sensitively reflected in the ejector performance, so extremely fine control of the pressure inside the refining vessel becomes difficult.

On the other hand, the method of using a water-sealed type vacuum pump is currently employed for control of the degree of vacuum by pump units, but this is not used together with ejectors, the capacity is insufficient for realizing a high vacuum by this alone, and extremely fine control of the degree of vacuum is impossible.

Further, in a vacuum refining vessel, in most cases, for efficient refining or for final adjustment of the ingredients of the melt, alloy or secondary materials are added to the melt in the middle of refining or at the end stage of refining. Normally, these are charged into the vessel and added to the melt by allowing them to naturally drop from an alloy hopper provided at the top of the refining vessel through a chute.

However, due to the argon blown into the refining vessel for agitating the melt or the oxygen blown for promoting decarburization, splash of the metal and slag, generation of dust, etc. occur inside the refining vessel. Therefore, the metal deposits at the alloy and secondary material addition port linked with the inside of the vessel and accordingly the addition port becomes blocked or other trouble easily occurs. Therefore, to suppress the occurrence of such trouble, the means has been adopted of providing the alloy and secondary material addition port with side walls resistant to the effects of the metal and slag or, in the case of a refining vessel with a high tank height, providing a top cover. Further, the means has also been adopted of using the alloy and secondary material addition port jointly as the insertion port of the top blowing lance. If considering continuous long term operation of a vacuum refining vessel, however, neither means is sufficient in practice.

Further, in treatment of the exhaust gas of a metallurgical furnace, including atmospheric and vacuum refining vessels, it is necessary to cool the high temperature exhaust gas produced. Therefore, sometimes a water-cooled type gas scrubber is provided in the middle of the ducts or the ducts are water cooled in the middle. In this case, heat is exchanged between the high temperature exhaust gas and the large amount of cooling water. Due to abrasion and reduced thickness of the piping and ducts, cracking due to thermal stress, etc., sometimes the cooling water leaks from the piping and ducts to the inside of the exhaust gas passage. Exhaust gas treatment equipment is generally closed, however, so it is impossible to obtain a grasp of the state of water leakage inside. Therefore, sometimes operation is continued while not being able to confirm internal water leakage and the water leakage becomes serious and leads to a remarkable drop in the degree of vacuum or the inability to remove dust from the system due to the water leakage or other trouble in equipment or operation.

Therefore, operation has been stopped on a scheduled basis at a certain frequency and the inside of the ducts checked and the gas cooler checked. Further, the practice has been to install an electrostatic capacity type detection rod at the dust collector at the bottom of the gas cooler and utilize the fact that dust changes in electrostatic capacity when wet by water leakage so as to detect water leakage.

If stopping operation and conducting checks on a scheduled basis, however, the operating efficiency of the facilities will be reduced and the productivity blocked. On the other hand, with the above-mentioned electrostatic capacity type detection rod, it is difficult to adjust the electrostatic capacity of the detection rod according to the state of wetness of the dust. For example, with a small amount of water leakage, if the temperature is high or under a vacuum, the water will easily turn into steam, so detection of water leakage will not be possible. The detection rod is predicated on detection of a large amount of water leakage. Therefore, it is extremely difficult to detect water leakage in advance while still slight.

Further, vacuum exhaust equipment for industrially evacuating a vacuum refining vessel generally achieves a predetermined degree of vacuum in the furnace by combining a large number of ejectors or using a vacuum pump. Vacuum ejectors utilize the so-called "mist-blowing principle" and suck in and exhaust the exhaust gas in the vacuum refining vessel and the ducts and other parts of the vacuum path by the ejected media. For the ejected medium, usually steam is used industrially. Steam is condensed by the cooling water at a condenser after the ejectors to become water again and therefore only the exhaust gas is exhausted to the next stage. The cooling water of the condenser and the condensed water of the steam are temporarily collected and stored at a water storage tank near the ground and are pumped to the cooling tower by a pump. On the other hand, as the vacuum pump, industrially a water-sealed pump is used and a large amount of water is used. The water used by the vacuum pump is collected and stored in a water storage tank in the same way as the condenser water.

Exhaust gas contains a large amount of CO gas. The condenser water is accompanied by large numbers of bubbles of exhaust gas containing CO which flow into the water storage tank along with it. Therefore, the inside of the water storage tank becomes an atmospheric gas containing CO gas in composition. In the sense of preventing the gas inside the tank from leaking outside the tank, closeability and sealability are very important as functions required for a water storage tank.

Water storage tanks come in generally two types: steel seal pots and concrete (the top cover part made of steel) hot wells. Steel seal pots have a good closeability, but suffer from the problems of corrosion and swelling capital costs. On the other hand, concrete hot wells are free from corrosion and relatively inexpensive in terms of capital costs as well, but suffer from problems in the sealability with the top steel covers. In the following description, the invention will be explained taking as an example mainly the latter concrete hot wells, but the invention may similarly be applied to steel seal pots.

There are two issues with hot wells. The first is that there is leakage of CO-containing gas from a hot well. The second is the suppression of damage to the equipment when the cooling water inside a hot well overflows.

As means for dealing with this, the method of forcibly evacuating the inside of the hot well by a suction fan is widely employed. Due to this, the inside of the hot well becomes a constantly negative pressure and the danger of leakage of the inside gas is remarkably reduced. However, the inside of a hot well being made negative pressure due to suction of gas means suction of air from the seal parts. The clearance of the seal parts therefore gradually expands. If the suction fan were to stop in this state for some reason or another, a large amount of CO-containing gas would leak from the expanded clearance of the seal parts.

Further, even if the power of the system of the return pump of the hot well is cut off for some reason and the return pump stops, the supply pump of the large-sized cooling tower will continue to operate. This being so, the cooling water in the hot well will continue to increase and will overflow. As a measure against this, it may be considered to attach a switch valve from another power source system to the supply pipe to the condenser and water-sealed pump, but tremendous expense would become required for the long distance pipeline and the large switching valve.

DISCLOSURE OF INVENTION

The present invention has as its object the provision of a refining method for a chromium-contained molten steel comprising refining by blowing a gas containing oxygen gas into a chromium-contained molten steel in a refining vessel and enabling a reduction of the amount of use of inert gas or oxygen gas and shortening of the refining time.

Further, the present invention has as its object the provision of a refining method able to shorten the time required for refining and reduce the refining cost in decarburization refining of an ultra-low carbon melt.

Further, the present invention provides a vacuum control method and apparatus in vacuum exhaust equipment able to control the degree of vacuum in a vessel or ducts at the time of refining a melt by oxygen decarburization in a vacuum refining vessel.

Further, the present invention has as its object the provision of a seal unit and seal method able to avoid blocking of an alloy and secondary material addition port even under refining conditions where the metal and slag are remarkably violently splashed.

Further, the present invention has as its object to detect with a high precision water leakage in an exhaust gas treatment apparatus in a metallurgical furnace or vessel of an atmospheric refining or vacuum refining apparatus, in particular a water-cooled duct, exhaust gas cooling unit, or other unit using cooling water and provides a detection unit able to detect even a slight amount of water leakage during treatment, easily to manage and maintain, and superior in durability.

Further, the present invention has as its object the provision of an apparatus for simply solving the problems in the hot well, that is, suppressing leakage of CO-containing gas from the hot well and damage to equipment at the time of overflow of the cooling water in the hot well.

The present invention was made to solve the above problems and has as its gist the following:

(1) A refining method refining by blowing a mixed gas including oxygen gas into a chromium-contained molten steel in a refining vessel, said refining method for a chromium-contained molten steel characterized by having a first step of blowing in said mixed gas while making the inside of the vessel a pressure of a range of 400 Torr (53 kPa) to atmospheric pressure, a second step of blowing said mixed gas while evacuating said vessel to 250 to 400 Torr (33 to 53 kPa), and a third step of blowing said mixed gas while further evacuating the inside of the vessel to not more than 250 Torr (33 kPa) and by refining step by step while switching from the first step to the second step at a concentration of carbon in the melt of 0.8 to 0.3% and switching from the second step to the third step at a concentration of carbon in the melt of 0.4 to 0.1%.

(2) A refining method for a chromium-contained molten steel as set forth in (1), characterized by refining while making the mixed gas blow rate at said second step at least 0.4 $Nm^3$/min per ton melt.

(3) A refining method for a chromium-contained molten steel as set forth in (1) or (2), characterized by, in said first step, performing refining comprising refining the entire amount under atmospheric pressure, refining the entire amount under a vacuum, or refining first at atmospheric pressure, then under a vacuum.

(4) A refining method for a chromium-contained molten steel as set forth in (1) or (3), characterized by, when refining under atmospheric pressure of said first step, refining using both top blowing and bottom blowing as the blowing of said mixed gas.

(5) A refining method for a chromium-contained molten steel as set forth in any one of (1) to (4), characterized by, when refining under atmospheric pressure of said first step, refining using only oxygen for the blowing of said mixed gas.

(6) A refining method for a chromium-contained molten steel as set forth in (1), characterized by, in said third step, refining by further evacuating step by step the inside of the vessel along with the decrease in concentration of carbon in the melt.

(7) A refining method for a chromium-contained molten steel as set forth in (1), characterized by, in said third step, refining by any means of supplying only inert gas for the blowing of said mixed gas, gradually reducing the ratio of supply of oxygen gas in said mixed gas along with the decrease in concentration of carbon in the melt, or supplying inert gas after the ratio of oxygen gas in said mixed gas decreases.

(8) A refining method for a chromium-contained molten steel as set forth in (1), characterized by starting evacuating the inside of said refining vessel, then blowing inert gas, nitrogen, or another non-oxidizing gas or a mixed gas of the same to reduce the concentration of oxygen in the exhaust gas to not more than 7 vol %, then blowing said mixed gas into said evacuated refining vessel and starting refining.

(9) A refining method for a chromium-contained molten steel as set forth in (1), characterized by, in said third step, reducing the concentration of carbon in the melt to not more than 0.08%, then restoring the pressure in the vessel to at least 400 Torr (53 kPa), then bottom blowing mixed gas and vacuum refining at a mixed gas blow rate of at least 0.4 $Nm^3$/min per ton melt so as to reduce the carbon to an ultra-low level.

(10) A refining method for a chromium-contained molten steel as set forth in (9), characterized, after said third step, by restoring the pressure inside the vessel to at least 400 Torr (53 kPa), then bottom blowing mixed gas, reducing the ratio of the oxygen gas in the blown mixed gas to not more than 30%, reducing the pressure inside the vessel to not more than 100 Torr (13 kPa), and continuing refining.

(11) A refining apparatus for a chromium-contained molten steel, said refining apparatus for a chromium-contained molten steel characterized by comprising a vacuum refining vessel, an alloy and sub-material addition unit provided above the vacuum refining vessel, exhaust gas cooler, vacuum valve, one-stage or multiple-stage ejector type vacuum exhaust unit, and water-sealed type vacuum pump arranged successively and by having a pressure control valve under a vacuum for returning part of the exhaust gas from down stream side of said water-sealed type vacuum pump to the upstream side of said water-sealed type vacuum pump.

(12) A refining apparatus for a chromium-contained molten steel as set forth in (11), characterized by being provided with a means for adjusting the opening degree of said vacuum control use pressure adjusting valve to control the degree of vacuum inside said vacuum refining vessel to return part of the exhaust gas exhausted from said water-sealed type vacuum pump to the upstream side of the exhaust gas passage of said water-sealed type vacuum pump.

(13) A refining apparatus for a chromium-contained molten steel as set forth in (11), characterized by providing a means arranging a vacuum valve between an exhaust side of said one-stage or multiple-stage ejector type vacuum exhaust unit and said water-sealed type vacuum pump and said vacuum refining vessel side of said exhaust gas cooler, closing said vacuum valve before the start of vacuum refining to place said ejector type vacuum exhaust unit and said water-sealed type vacuum pump in a vacuum state in advance, and opening said vacuum valve simultaneously with the start of vacuum refining to raise the degree of vacuum of the vacuum refining vessel.

(14) A refining apparatus for a chromium-contained molten steel as set forth in (11), characterized by providing a means for adjusting the opening degree of said vacuum control use pressure control valve under a vacuum in advance to restore up to 10% of the flow of exhaust gas to the upstream side of said water-sealed type vacuum pump and then immediately adjusting the degree of vacuum in said vacuum refining vessel when adding alloy and sub-material during refining under a vacuum in the vacuum refining vessel.

(15) A refining apparatus for a chromium-contained molten steel as set forth in (11), characterized by providing a seal unit having a seal valve for sealing an addition port at the bottom of said alloy and secondary material adding unit and setting a dummy lance integrally with said seal unit at the bottom of said seal valve or setting it elevatably linked with said seal unit.

(16) A refining apparatus for a chromium-contained molten steel as set forth in (15), characterized by providing a seal port for blowing seal gas to a clearance between inside walls of the addition port of said alloy and secondary material unit and said dummy lance.

(17) A refining apparatus for a chromium-contained molten steel as set forth in (11), characterized by providing a center cover having a cooling function at the bottom of said alloy and secondary material addition unit.

(18) A refining apparatus for a chromium-contained molten steel as set forth in (11), characterized by providing at the back of said exhaust gas cooler inside the refining apparatus system a water leakage detection unit able to detect water leakage by measuring at least one of a steam temperature or steam pressure in the exhaust gas.

(19) A refining apparatus for a chromium-contained molten steel as set forth in (11), characterized by arranging at the back of said one-stage or multiple-stage ejector type vacuum exhaust unit and said water-sealed type vacuum pump a return water storage tank linked with these and attached to a gas ventilation unit.

(20) A refining apparatus for a chromium-contained molten steel as set forth in (19), characterized by providing a water-sealed cover having a partition cover provided, without being fixed, at the top of said return water storage tank.

(21) A refining apparatus for a chromium-contained molten steel as set forth in (20) or (21), characterized in that the weight of said water-sealed cover satisfies the following formula (1):

$$(W1+W2)\times 9.8>P\times S \quad (1)$$

where,

W1: weight of partition cover (kg)

W2: weight of weight placed on partition cover (kg)

P: maximum gas pressure acting inside return water storage tank (Pa)

S: maximum area of projection of inside surface of movable partition cover on horizontal plane ($m^2$)

(22) A refining apparatus for a chromium-contained molten steel as set forth in (20) or (21), characterized in that the water-sealing height of said water-sealed cover satisfies the following formula:

$$H-L>9.8\times 10^3\times P \quad (2)$$

where,

H: height of outside outer tube of partition cover side walls of water-sealed cover (m)

P: maximum gas pressure acting at inside of return water storage tank (Pa)

L: height of sealing water passage between inner tube and outer tube in water-sealed cover (m).

BEST MODE FOR CARRYING OUT THE INVENTION

Figure 1A:
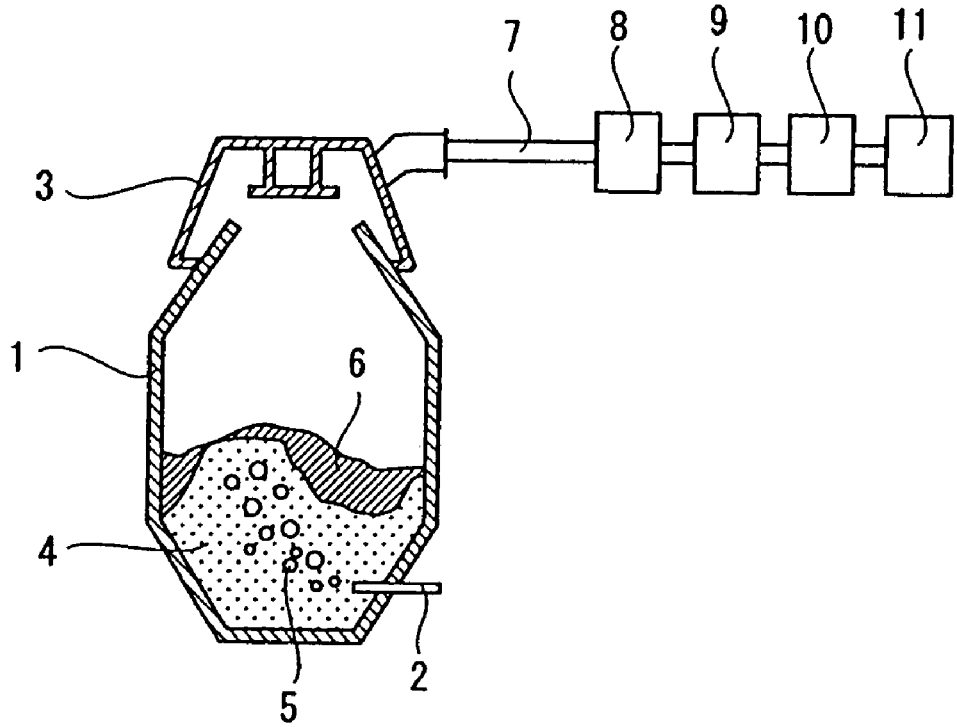
FIG. 1 are views of a refining vessel of the present invention, wherein (a) shows the state at the time of vacuum refining and (b) shows the state at the time of atmospheric pressure refining.
Figure 1B:
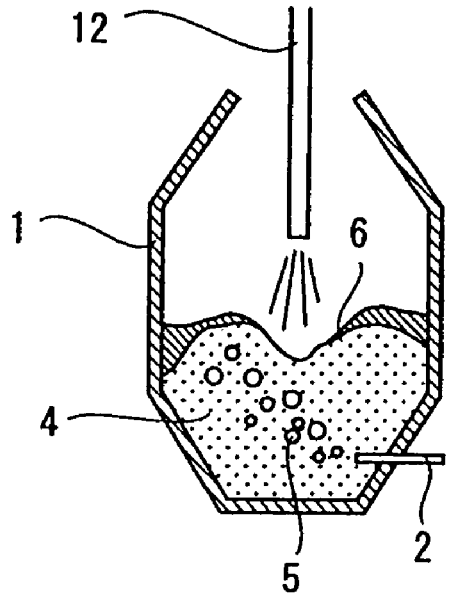

In the present invention, at the time of vacuum refining, for example, when the refining vessel 1 shown in FIG. 1(*a*) performs atmospheric pressure refining, for example, a refining vessel 1 shown in FIG. 1(*b*) is used. Refining gas is blown into the chromium-contained molten steel in the refining vessel through a bottom blowing tuyere 2. Further, the refining vessel 1 has a detachable exhaust hood 3. At the time of vacuum refining, as shown in FIG. 1(*a*), an exhaust hood 3 is attached to the refining vessel 1 and gas is sucked out to evacuate the refining vessel. At the time of atmospheric pressure refining, as shown in FIG. 1(*b*), the exhaust hood 3 is not attached, so as the blown gas, it is also possible to blow gas while using not only the bottom blowing tuyere 2, but also a top blowing lance 12.

The present invention, as explained in the above (1), has as its biggest feature having a step of blowing a gas containing oxygen gas while evacuating the inside of the vessel to 250 to 400 Torr (33 to 53 kPa) in the refining process. This step is called the "second step". By arranging this step (hereinafter generally referred to as the "second step") in the medium carbon region around a concentration of carbon of 0.4 wt % and vigorously stirring the melt simultaneously, it is possible to maintain the oxygen efficiency for decarburization in the medium carbon region at a high value and further possible to suppress the generation of dust.

Figure 2:
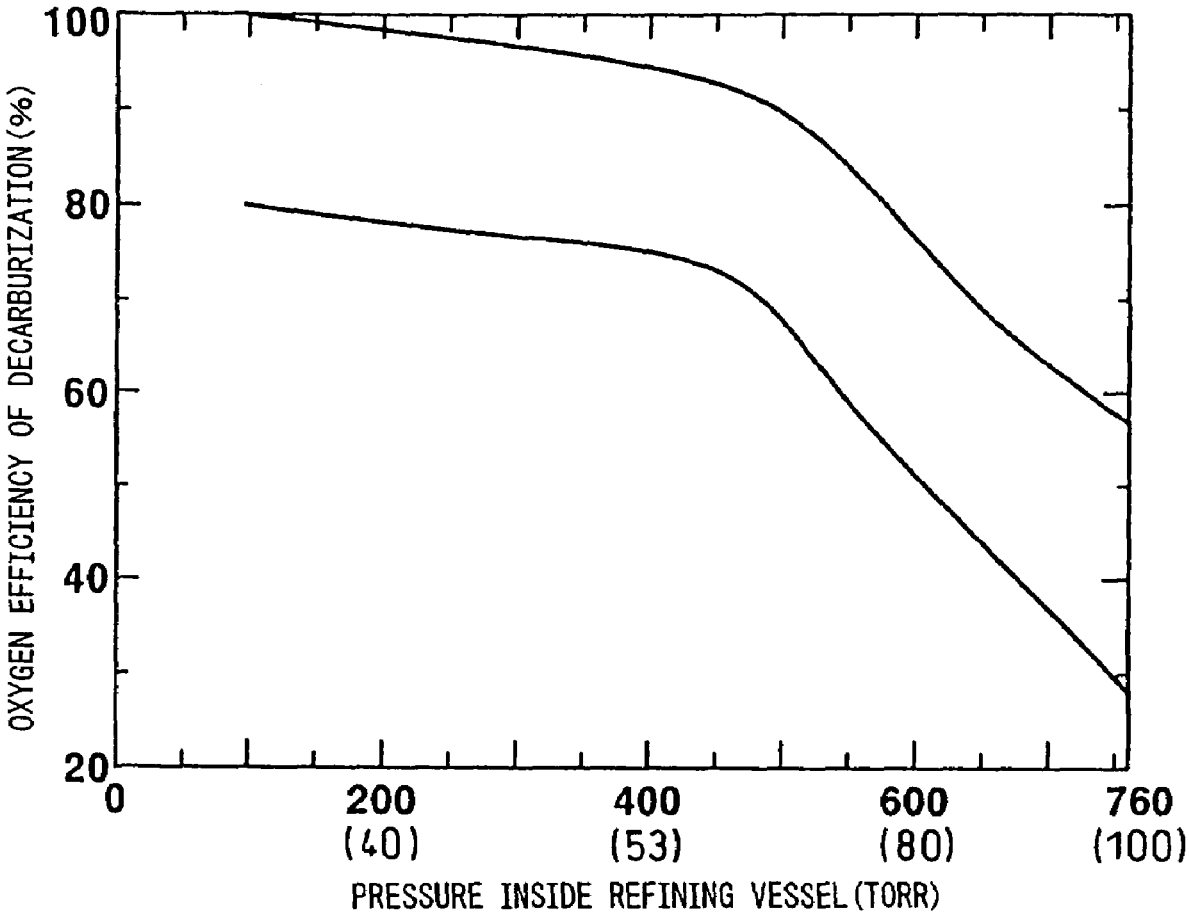
FIG. 2 is a view of the relationship between the pressure inside a refining vessel and oxygen efficiency for decarburization.

FIG. 2 shows the relationship between the pressure inside the refining vessel and the oxygen efficiency for decarburization when making the bottom blowing gas blow rate 0.4 to 0.9 $Nm^3$/min per ton melt. It is learned that up until the region above a pressure inside the vessel of 400 Torr (53 kPa), a high oxygen efficiency for decarburization can be maintained. Note that at under 100 Torr (13 kPa), the amount of generation of dust is large and operation not possible.

Figure 3:
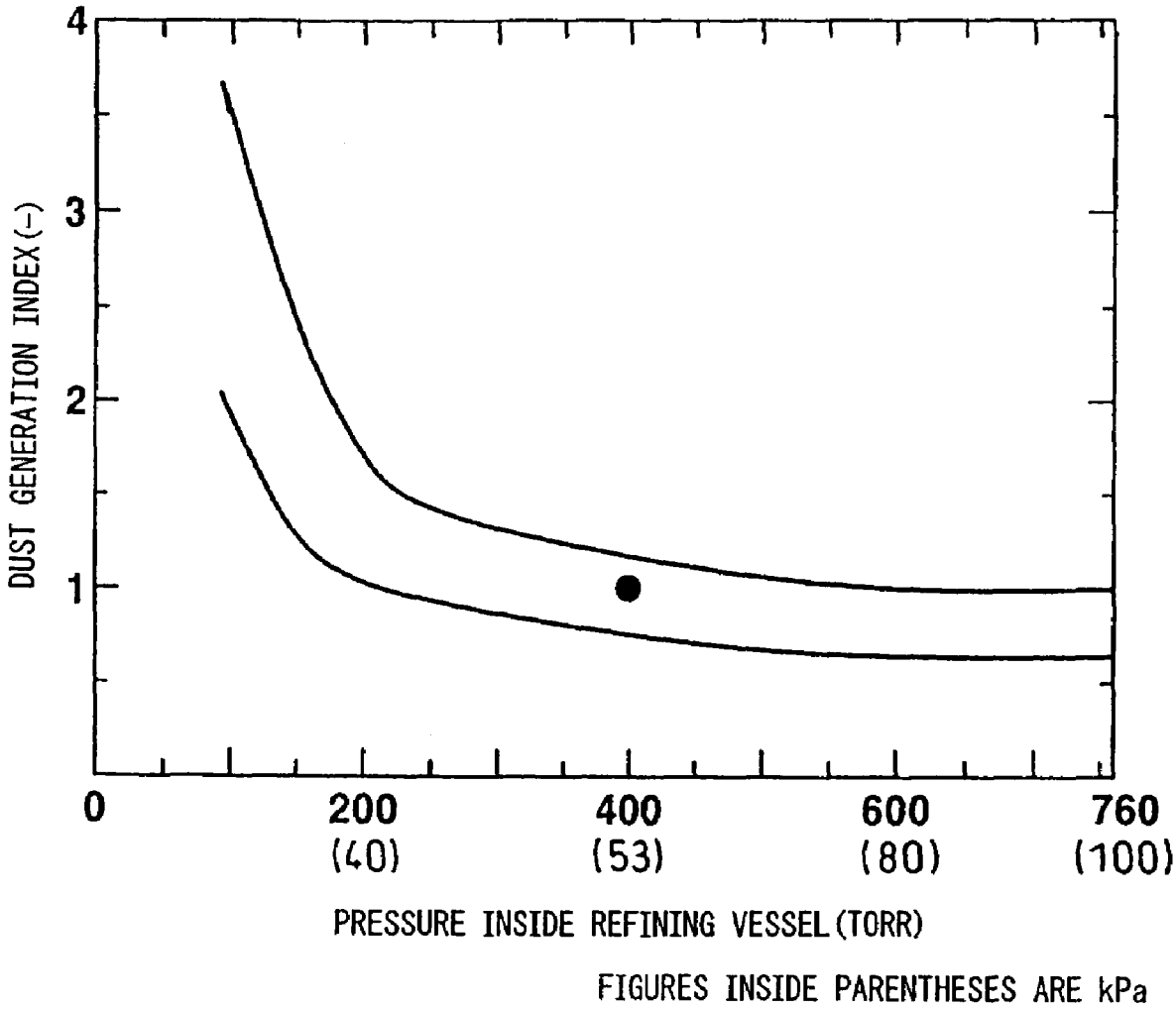
FIG. 3 is a view of the relationship between the pressure inside a refining vessel and a dust generation index.

FIG. 3 is a view of the relationship between the pressure inside the refining vessel and dust generation index when making the bottom blowing gas blow rate 0.4 to 0.9 $Nm^3$/min per ton melt. The dust generation index is a value indexed to the average value of the dust generation at a pressure inside the vessel of 400 Torr (53 kPa). It is learned that by making the pressure inside the refining vessel at least 250 Torr (33 kPa), it is possible to greatly reduce the dust generation.

By making the pressure the range of 250 to 400 Torr (33 to 53 kPa) at the second step, it is possible to achieve an increase of the bottom blowing gas blow rate and as a result possible to achieve a shorter refining time. The bottom blowing gas blow rate is preferably made at least 0.4 $Nm^3$/min per ton melt. Due to this, it is possible to realize strong agitation for obtaining a high oxygen efficiency for decarburization by a pressure of at least 250 Torr (33 kPa) and shorten the refining time and possible to keep the dust generation to a low level even if the blow rate of the bottom blowing gas is at least 0.4 $Nm^3$/min per ton melt if the pressure is at least 250 Torr (33 kPa). The bottom blowing gas blow rate can give even more preferable results if over 0.5 $Nm^3$/min per ton melt.

As the timing for shifting from the first step where the pressure inside the refining vessel is at least 400 Torr (53 kPa) to the second step of 250 to 400 Torr (33 to 53 kPa), it is preferable to shift when the concentration of carbon in the melt is 0.8 to 0.3%. This is because in the carbon region where the concentration of carbon is higher than 0.8%, even if refining under a vacuum, setting the pressure to a pressure higher than 400 Torr (53 kPa) and increasing the oxygen gas blow rate enables more efficient refining or refining under atmospheric pressure and jointly using blowing of top blown oxygen gas secures a high oxygen gas blow rate and enables efficient refining. Of course even if starting the second step from the region where the concentration of carbon is at least 0.8%, for example, a concentration of carbon of 1.0%, it is possible to obtain the effect of the present invention. On the other hand, if continuing the refining at a pressure over 400 Torr (53 kPa) up to the carbon region of a concentration of carbon lower than 0.3%, a reduction in the oxygen efficiency for decarburization is caused and prolongation of the refining time is led to, so this is not preferable. Of course, even if starting the second step from the area where the concentration of carbon is not more than 0.3%, for example, a concentration of carbon of 0.2%, it is possible to obtain the effect of the present invention. Most preferably, it is sufficient to shift to the second step when the concentration of carbon in the melt is 0.5 to 0.4%.

As the timing for shifting from the second step where the pressure inside the refining vessel is 250 to 400 Torr (33 to 53 kPa) to the third step where the pressure is not more than 250 Torr (33 kPa), it is preferable to shift when the concentration of carbon in the melt is 0.4 to 0.1%. This is because by making the carbon region where the concentration of carbon is higher than 0.4% a pressure of 250 to 400 Torr (33 to 53 kPa), it is possible to sufficiently obtain the effect of the present invention of improving the refining efficiency and reducing the dust generation. Of course, even if shifting to the third step from the concentration of carbon of 0.5%, it is possible to obtain the effect of the present invention. On the other hand, if continuing refining by a pressure over 250 Torr (33 kPa) up to the carbon region with a concentration of carbon lower than 0.1%, a reduction in the oxygen efficiency for decarburization is caused and prolongation of the refining time is caused, so this is not preferable. Of course, even if starting the third step from the region where the concentration of carbon is not more than 0.1%, for example, the concentration of carbon is 0.05%, the effect of the present invention can be obtain. Most preferably, it is sufficient to shift to the third step at a concentration of carbon in the melt of 0.3 to 0.2%.

As to the type of the blown gas of the bottom blown gas at the second step, it may be made a mixed gas of oxygen and an inert gas from the start of the second step, but it is also possible to use a pattern of first blowing oxygen gas alone and then successively increasing the ratio of the inert gas in the second step.

The pressure in the refining vessel at the second step can be held at a certain pressure in the range of 250 to 400 Torr (33 to 53 kPa), but if adopting a pattern of successively changing from a high pressure to a low pressure, it is possible to decarburize the melt while maintaining a substantially constant high oxygen efficiency for decarburization without mixing in inert gas, so more preferable results can be obtained.

Regarding the stage before the second step, that is, the first step, it is sufficient to employ either of the case of refining the entire amount under atmospheric pressure, the case of refining the entire amount under a vacuum, and the case of refining first under atmospheric pressure and then under a vacuum.

When refining under atmospheric pressure at the first step, since no exhaust hood 3 is provided for vacuum refining above the refining vessel, it is possible to jointly use top blowing and bottom blowing as the gas blowing. Further, since the exhaust gas is treated under atmospheric pressure, the exhaust gas suction capability can be increased compared with vacuum refining. Under such conditions, by top blowing in addition to bottom blowing, it is possible to increase the overall amount of blown gas and promote the progress in the decarburization refining. The lower the concentration of carbon, the lower the carbon monoxide partial pressure $P_{CO}$ in the gas at equilibrium with the chromium in the melt. Therefore, in refining under atmospheric pressure, to prevent oxidation loss of chromium, it is necessary to mix argon or another inert gas in the blown gas, reduce the concentration of carbon, increase the ratio of inert gas, and reduce the $P_{CO}$ in the atmosphere.

When refining under atmospheric pressure in the first step, it is possible to use only oxygen as the blown gas. This is because with a range of carbon in the first step of 0.8 to 0.3% or more, the $P_{CO}$ at equilibrium with the chromium in the melt is at least 0.7 atm. Even if using only oxygen as the blown gas, the extent of decline of the oxygen efficiency for decarburization is small and a high decarburization rate is obtained. Further, it is possible to suppress use of expensive inert gas. Note that if making the range of carbon in the first step at least 0.5%, the $P_{CO}$ at equilibrium with the chromium in the melt becomes at least 0.9 atm, so a higher effect is obtained.

It is possible to perform the reduction of the first step under atmospheric pressure at first and then perform it under a vacuum of a pressure of at least 400 Torr (53 kPa). If adopting vacuum refining in the latter half of the first step, compared with the case of refining the same region under atmospheric pressure, it is possible to hold the $P_{CO}$ low even when reducing the ratio of mixture of inert gas or blowing only oxygen gas not using inert gas at all and perform refining preventing oxidation of chromium. As the timing for shifting from atmospheric pressure to a vacuum, it is preferable to shift in the region of the concentration of carbon of 0.8 to 0.5%. This is because below the concentration of carbon, addition of a means for reducing the $P_{CO}$ so that the $P_{CO}$ at equilibrium with the chromium in the melt becomes not more than 1 atm enables more efficient decarburization. The reason for making the pressure at least 400 Torr (53 kPa) is that if in the region of concentration of carbon of the first step, the content of carbon becomes high, so it is possible to obtain a sufficiently excellent oxygen efficiency for decarburization even under high pressure. Further, in the carbon region, it is important to secure the amount of blown gas and secure a high refining efficiency, but if using the same vacuum suction unit, the higher the pressure, the greater the exhaust gas suction capacity and the greater the amount of blown gas that can be obtained. Together with this, a high pressure enables generation of dust and splashing of the fine particles of metal produced from the melt surface in the vacuum refining vessel to be suppressed even with the same gas blow rate.

Regarding the degree of vacuum in each step, vacuum oxygen decarburization is possible while controlling the vacuum to the target degree of vacuum by the later explained control. Further, there may be a plurality of target degrees of vacuum controlled in each step.

While the extent of the effect becomes smaller compared with the second step, in the first step as well, the higher the gas blow rate from the bottom blowing, the greater the agitation force of the melt and the higher the level the oxygen efficiency for decarburization can be held at, so it is preferable to make the rate at least 0.4 $Nm^3$/min per ton melt. Further, the higher the blow rate, the higher the oxygen supply rate obtained and the shorter the refining time can be made.

It is also possible to perform the vacuum refining from the start of the first step. For example, when there is extra leeway in the production capacity and the refining time can be extended, vacuum refining is performed from the start of the first step. Due to this, the supply rate of the oxygen falls and refining time becomes longer, but it becomes possible to hold the oxygen efficiency for decarburization at a high level in the refining as a whole. For example, it becomes possible to secure an oxygen efficiency for decarburization of the refining as a whole of at least 90%. Along with this, it becomes possible to keep use of expensive dilution gas to a minimum.

Regarding the step after the second step, that is, the third step, the inside of the vessel is evacuated to 250 Torr (33 kPa) and gas blown in. The more the concentration of carbon in the melt falls, the lower the optimal pressure in the vessel for obtaining a high oxygen efficiency for decarburization, so in the third step where decarburization proceeds, it is preferable to employ a pressure lower than the second step. Along with this, the lower the concentration of carbon, the greater the effect of melt agitation on the decarburization reaction. With the same gas blow rate, the lower the pressure inside the vessel, the larger the expansion of the gas and the greater the melt agitation force, so the pressure is preferably made lower than the second step.

In the third step, it is preferable to successively evacuate in the vessel step by step along with the decline in the concentration of carbon in the melt. It is further preferable to successively evacuate the inside the vessel to a pressure inside the vessel at the final stage of the decarburization refining of not more than 50 Torr (7 kPa). In the region of low concentration of carbon, along with the drop in the concentration of carbon, the $P_{CO}$ at equilibrium with the chromium in the melt rapidly falls. For example, at a carbon of 0.2%, the equilibrium $P_{CO}$ is about 0.3 atm, but at a carbon of 0.1%, it becomes not more than 0.1 atm. If evacuating the vessel step by step corresponding to this, it is possible to stably hold the oxygen efficiency for decarburization at a high level.

In the third step, the concentration of carbon sufficiently falls, so the blown gas may be made a mixed gas not containing oxygen gas or only an inert gas. Further, when supplying a mixed gas of oxygen gas and an inert gas as the blown gas, it is preferable to gradually reduce the ratio of the oxygen gas in the mixed gas along with the decline in concentration of carbon in the melt. Compared with when the blown gas is just an inert gas, when suitably mixing in oxygen gas, efficient decarburization can be performed after securing the rate of supply of oxygen, so it is possible to shorten the refining time. Further, along with the drop in the concentration of carbon, the $P_{CO}$ at equilibrium with the chromium in the melt rapidly falls, so if reducing the ratio of oxygen gas of the blown gas, efficient decarburization becomes possible. Further, there are cases where the refining is performed while making the blown gas only inert gas in the final stage of the third stage. Further, it is possible to charge ferrosilicon immediately before or after making the blown gas an inert gas so as to reduce the chromic acid in the slag on the melt and improve the yield of chromium (chromium) or other valuable metals.

As explained above, the lower the concentration of carbon, the greater the effect of the melt agitation on the decarburization reaction. The third step evacuates the vessel more than the second step, but the rate of the blown gas is preferably made at least 0.4 $Nm^3$/min per ton melt as well. Note that if the rate of blown gas becomes too large, a large amount of splash will be generated and will hinder operation, so it is preferable to make the rate not more than 1.0 $Nm^3$/min per ton melt.

Note that when supplying bottom blown gas inside the refining vessel, generally a double tuyere is used. With a double tuyere, the refining gas is passed through an inner tube and the cooling gas through an outer tube. Even when blowing in oxygen gas alone in the present invention, the outer tube is supplied with a small amount of a cooling gas such as nitrogen or argon or propane or another hydrocarbon gas or a mixed gas of the same. Further, the gas mixed with the oxygen ($O_2$) may be argon or another inert gas, $N_2$, CO, or $CO_2$ alone or in a mixture.

In the vacuum refining method of the present invention, compared with the conventional vacuum refining method, the amount of blown gas is increased, so it becomes necessary to consider a vacuum exhaust unit for evacuating the inside the refining vessel. An increase in the amount of heat generation due to the increase in the amount of exhaust gas can be dealt with by increasing number of the gas coolers 8 installed in the exhaust pipe 7 between the exhaust hood 3 and the vacuum exhaust unit (steam ejector 10 or water pump 11) shown in FIG. 1(*a*) or the cooling capacity per unit. Further, an increase in the amount of dust generation due to the increase in the amount of exhaust gas can be dealt with by increasing number of the bag filters 9 installed in the exhaust pipe between the exhaust hood 3 and the vacuum exhaust unit or the dust treatment capacity per unit. In the present invention, as a result of making the pressure inside the refining vessel in the second step higher than in the past, the amount of dust generation is reduced, so even when increasing the bag filters, the minimum increase is enough.

Further, in the present invention, when refining an ultra-low carbon chrome melt, the pressure in the vessel is restored to at least 400 Torr (53 kPa) after the first vacuum refining up to the third step. By restoring the pressure in this way and then performing the second vacuum refining and making the gas blow rate of the second vacuum refining at least 0.4 $Nm^3$/min per ton melt, it is possible to greatly improve the oxygen efficiency of decarburization in the ultra-low carbon region. If producing ultra-low carbon chromium steel with a concentration of carbon of not more than 0.01% in the first-stage vacuum refining as in the past, it is necessary to continue the vacuum refining for at least 20 minutes, while if restoring the pressure in the middle of the vacuum refining for two-stage evacuation as in the present invention, it becomes possible to shorten the total time of the vacuum refining by about 10 minutes and produce similar ultra-low carbon steel.

When the concentration of carbon falls to a predetermined concentration, the refining under atmospheric pressure is suspended, the exhaust hood 3 is attached to the refining vessel 1, and the vacuum refining is started. In the process of reduction of the degree of vacuum at the time of start of the vacuum refining from atmospheric pressure, a rapid decarburization reaction proceeds even without the supply of oxygen gas. An amount of oxygen at equilibrium with the CO gas partial pressure of the atmosphere dissolves in the melt. By evacuating the vessel, the CO gas partial pressure of the atmosphere falls, so the oxygen which cannot dissolve bonds with the carbon in the melt resulting in the reaction. This-is called "natural decarburization". The inventors conducted various experiments and found quantitatively that amount of natural decarburization does not greatly depend on the melt composition, melt temperature, evacuation, or other conditions and is about 0.05%.

The reason why decarburization in the ultra-low carbon region is promoted by restoring the pressure in the middle of the first vacuum refining and making the gas blow rate of the second vacuum refining at least 0.4 $Nm^3$/min per ton melt is not necessarily clear, but it is believed that under strong agitation by the bottom blown gas, the above-mentioned effect of natural decarburization is obtained even in the region where the concentration of carbon falls. That is, it is believed that by restoring pressure in the middle of the vacuum refining, the concentration of oxygen dissolving in the melt increases and that by again evacuating the vessel, a decarburization reaction easily arises in the process of decline in the concentration of dissolvable oxygen.

As the timing of restoration of pressure, if restoring pressure when the concentration of carbon falls to 0.05 to 0.12 wt %, the effect of the present invention can be obtained. As explained above, the amount of natural decarburization occurring when evacuating the vessel is about 0.05%. It is sufficient to decarburize the melt to the concentration of carbon at the time of restoration of pressure minus this amount in the second vacuum refining. If the concentration of carbon at the time of restoration of pressure exceeds 0.12%, the amount of decarburization at the second vacuum refining increases and a sufficient effect can no longer be obtained. As set forth in the above (9) of the present invention, it is possible to obtain the most preferable effect if restoring the pressure after decarburizing the melt to a concentration of carbon in the melt of not more than 0.08 wt % in the first vacuum refining.

The gas blow rate in the second vacuum refining is made at least 0.4 $Nm^3$/min per ton melt. For example, even if restoring the pressure in the middle of the vacuum refining, with a gas blow rate in the second vacuum refining of about 0.3 $Nm^3$/min per ton melt of a level like the past, the vacuum refining time for producing the ultra-low carbon steel can only be shortened by about 1 to 3 minutes compared with the conventional one-stage vacuum refining. Further, even if making the gas blow rate in the first-stage vacuum refining at least 0.4 $Nm^3$/min per ton melt in the same way as in the present invention, it is only possible to obtain a very slight shortening of the vacuum refining time. More preferable results can be obtained if making the gas blow rate in the second vacuum refining at least 0.5 $Nm^3$/min per ton melt. The concentration of carbon after natural decarburization in the second vacuum refining is not more than 0.05%. The decarburization reaction becomes completely regulated by the diffusion of carbon. In promoting progress in decarburization, the gas blow rate becomes an important factor. In the present invention, the inventors discovered that the rate is at least 0.4 $Nm^3$/min per ton melt.

At the time of the start of the second vacuum refining, the concentration of carbon is reduced to not more than 0.1% or so, so the pressure inside the vessel is made a pressure of not more than 200 Torr (25 kPa) to suppress the oxidation of chromium and secure a high oxygen efficiency for decarburization. Further, as set forth in (10) of the present invention, the pressure inside the vessel at the second vacuum refining is preferably made not more than 100 Torr (13 kPA). This is because the lower the pressure in the vessel, the lower the concentration of oxygen dissolving in the melt and because with the same gas supply rate, the agitation force due to expansion of the gas becomes larger and therefore the decarburization rate becomes higher. To enjoy these effects, it is effective-to make the pressure not more than 100 Torr (13 kPa). More preferably the pressure inside the vessel in the second vacuum refining is made not more than 50 Torr (7 kPa).

The gas blown in the second vacuum refining may be made a mixed gas of oxygen gas and an inert gas. In the second vacuum refining, the concentration of carbon falls, so to suppress oxidation of chromium and obtain a high oxygen efficiency for decarburization, it is not possible to make the ratio of the oxygen gas that high. As set forth in the above (10) of the present invention, the ratio of the oxygen gas in gas blown in the second vacuum refining is preferably made not more than 30%. If the ratio of the oxygen gas exceeds 30%, the amount of oxygen used for the oxidation of the chromium in the melt rapidly increases. Over half of the oxygen gas blown in is used for oxidation of the chromium, so the ratio is preferably made not more than 30%. More preferably, the ratio of the oxygen gas may be made about 10%.

Next, the refining apparatus according to the present invention will be explained by the drawings.

Figure 4:
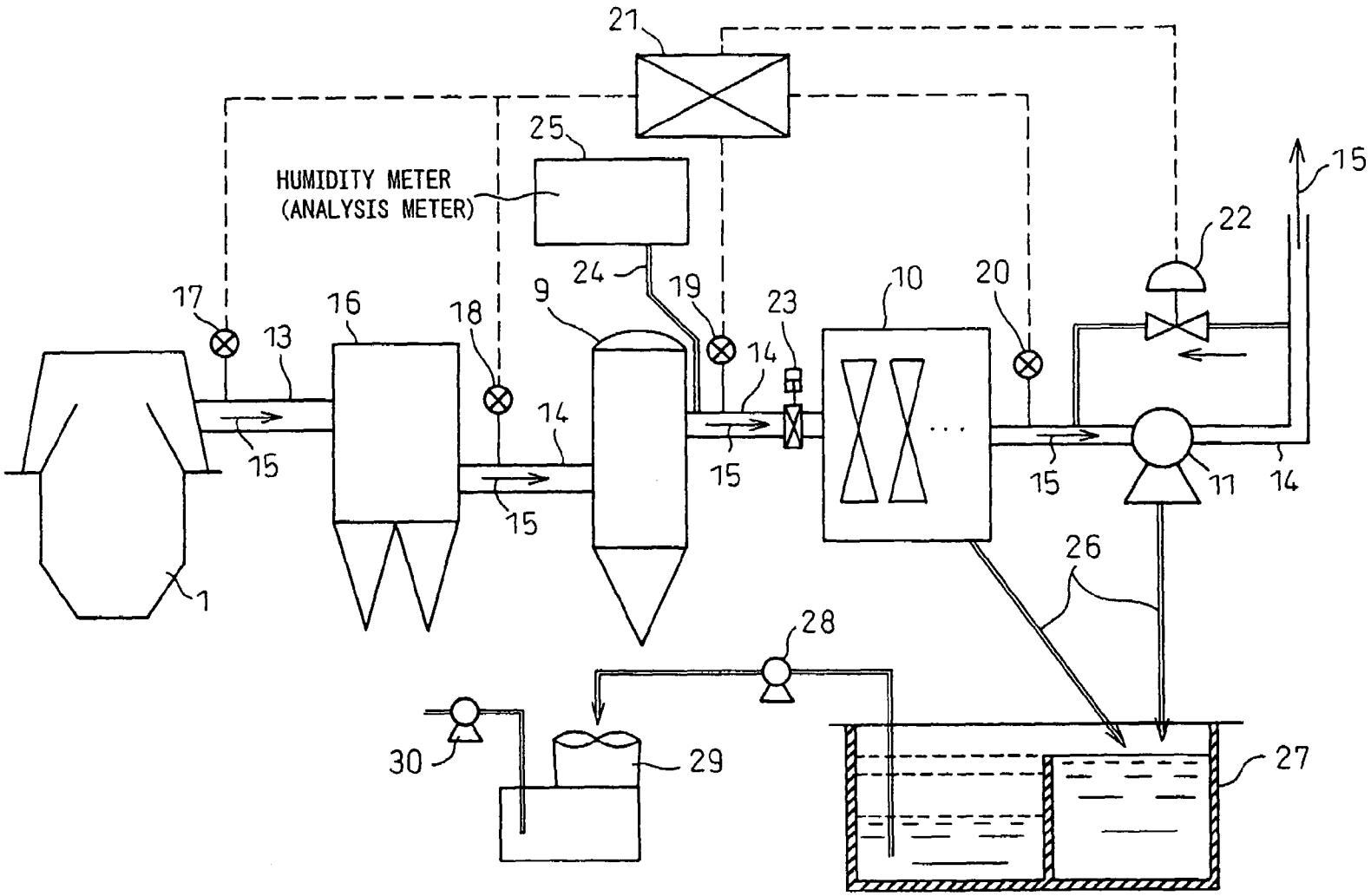
FIG. 4 is a view schematically showing an exhaust gas treatment unit of a vacuum refining facility.

A conceptual view of the exhaust gas treatment equipment of the present invention is shown in FIG. 4. The exhaust gas 15 produced in the vacuum refining furnace 1 passes through the water-cooled duct 13 and is cooled by an exhaust gas cooler 16 connected there. Next, it passes through the duct 14, is cleaned of dust by the dust collector 9, passes through the multiple-stage ejector-type vacuum exhaust unit 10, is further sucked in by the water-sealed type vacuum pump 11, and is discharged into the atmosphere.

Here, the degree of vacuum of any of the vacuum meter 17 in the furnace, the vacuum meter 18 after the exhaust gas cooler, the vacuum meter 19 after the dust collector, and the vacuum meter 20 after the multiple-stage ejector type vacuum exhaust unit is measured and the pressure signal input to the control unit 21. Part of the exhaust gas is returned to the front of the vacuum pump 11 while adjusting the opening degree of the vacuum control use pressure adjustment valve 22. Due to this, it becomes possible to control the inside of the vacuum refining vessel or the inside of the ducts to a predetermined target degree of vacuum. In controlling the degree of vacuum, it is possible to freely select which signal of the vacuum meters to use according to the stage of refining.

The level of degree of vacuum controlled to depends on the amount of splashing of metal from the vacuum refining vessel and the amount of oxidation of chromium in the melt. In general, if the degree of vacuum becomes better (the pressure value becomes lower), the carbon in the melt will be preferentially oxidized and the amount of oxidation of the chromium will be reduced. However, the amount of metal and slag splashed from the vacuum refining vessel will increase. That is, from the region of low chromium oxidation loss, it is better to increase the degree of vacuum, but from the region of low metal and slag, it is better to reduce the degree of vacuum. Therefore, considering the two, there is an optimal range of the degree of vacuum controlled to. Further, the amount of oxidation of the chromium in the melt and the amount of splash of the metal and slag also depend on the amount of carbon in the melt.

Next, the method of use of this apparatus will be explained based on FIG. 4.

Before starting the vacuum refining, a vacuum valve 23 at the front of the vacuum exhaust unit is closed and the vacuum exhaust equipment side, including the ejectors and the water-sealed type vacuum pump, and the vacuum refining vessel side, including the exhaust gas cooler or the dust collector, are separated by the vacuum valve 23. Here, the inside of the vacuum equipment side is controlled in degree of vacuum to a target 98 Torr (13 kPa) based on the signal of the vacuum meter 20. (This is called "operation prevacuum treatment".)

The vacuum pump 11 controls the degree of vacuum while setting the above degree of vacuum since when the degree of vacuum becomes 51 to 61 Torr (7 to 8 kPa), the water rapidly evaporates and cavitation is caused. In the past, when reaching below 61 Torr (8 kPa), a cavitation prevention valve was used to relieve the pressure and adjust the degree of vacuum, but the increase in the frequency of operation of the prevention valve caused the problem of leaks of the valve body. However, due to the present invention, the frequency of operation of the prevention valve is sharply reduced and there is no longer any leakage from the valve body. Accordingly, the degree of vacuum is controlled to a range of 61 Torr (8 kPa) or more.

Further, when then equalizing pressure with the atmospheric pressure refining vessel side, it is preferable that the degree of vacuum of the prevacuum treatment be as high a degree of vacuum as possible to suppress a drop in the degree of vacuum. Accordingly, the range of control of the degree of vacuum of the prevacuum treatment was made 61 to 205 Torr (8 to 27 kPa) in consideration of the controllability of the vacuum control use pressure adjustment valve 22.

After the end of preparations for treatment at the refining vessel side, the inside of the furnace starts to be evacuated. Simultaneously with the start of treatment, the vacuum valve 14 is opened, the vacuum exhaust equipment side and the vacuum refining vessel side are made the same degree of vacuum, then the passage as a whole is quickly made a high vacuum by the vacuum exhaust unit.

Figure 5:
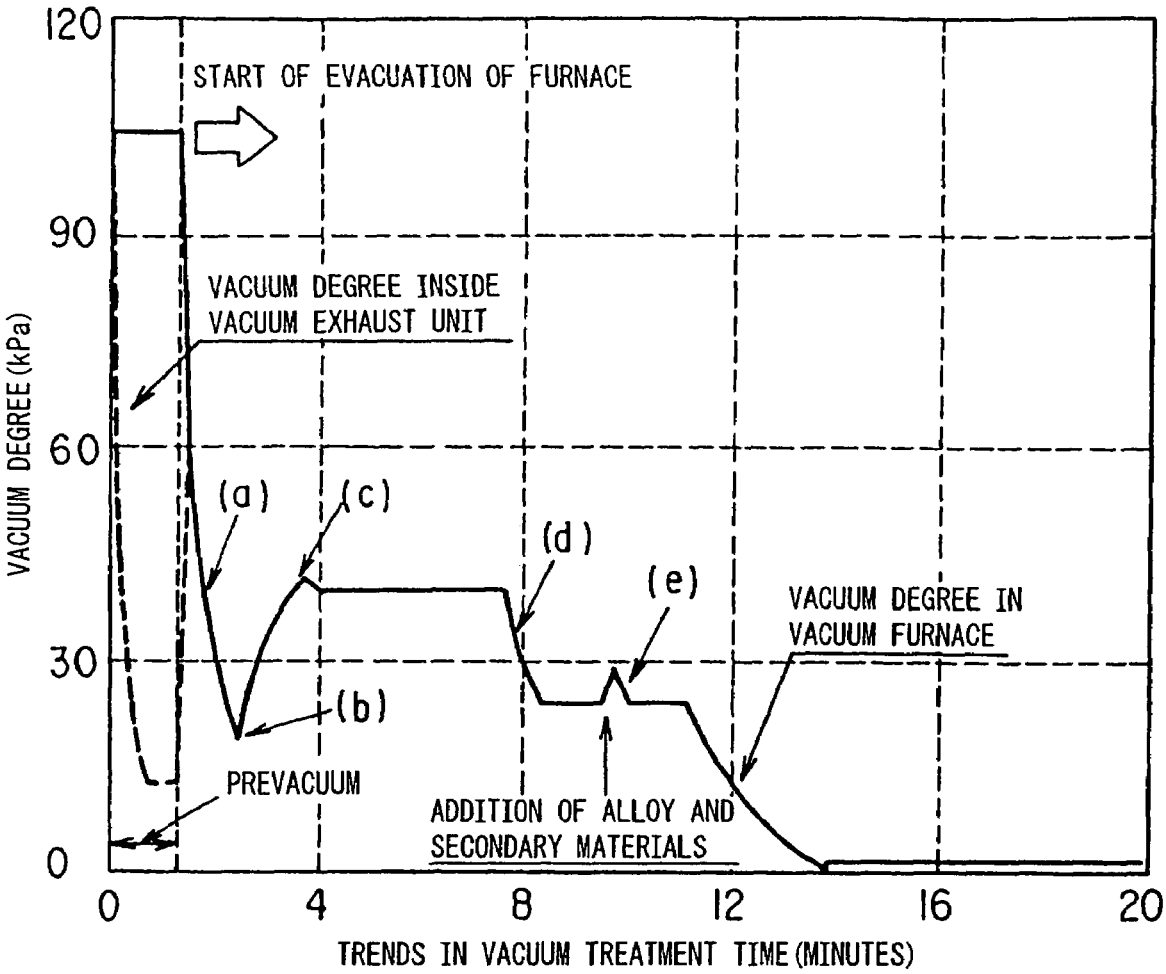
FIG. 5 is a view of the trends in the vacuum treatment time and the change in degree of vacuum in a vacuum refining furnace and a vacuum exhaust unit.

When starting the vacuum treatment and evacuating the passage as a whole, it is desirable to quickly close the vacuum control use pressure adjustment valve 22 and raise the degree of vacuum. However, before opening the vacuum valve 23, the pressure adjustment valve 22 becomes close to fully opened by control of the degree of vacuum. For example, with control of the degree of vacuum based on feedback control by the signal of the vacuum meter 17 inside the vessel, it is difficult to quickly close the pressure control valve in opening degree. Therefore, by forcibly fixing the opening degree of the pressure adjustment valve to not more than 20%, preferably to fully closed, at the same time as the signal for starting the vacuum and eliminating the return of the exhaust gas after the vacuum pump, it becomes possible to quickly increase the degree of vacuum. The effect of raising the degree of vacuum of (a) of FIG. 5 is obtained. Here, from the general valve characteristics of the pressure adjustment valve 22, if the opening degree becomes not more than 20%, it becomes close to fully closed and has the characteristic of blocking fluid.

To shorten the treatment time, it is desirable to start the oxygen decarburization as quickly as possible after the start of vacuum. However, a large amount of CO gas is produced simultaneously with blowing oxygen. If oxygen remains in the vacuum refining vessel or the vacuum ducts, it will react with the produced CO gas and give rise to the danger of combustion and explosion. Therefore, it is necessary to quickly reduce the concentration of oxygen in the vacuum refining vessel and vacuum ducts to below the explosion limit. As the method for this, it is effective to blow into the vacuum refining furnace a large amount of inert gas, not containing oxygen, or nitrogen or a mixed gas of the same. However, if not blowing in a dilution gas in the state after raising the degree of vacuum, a large amount of dilution gas becomes necessary. The concentration of oxygen in the exhaust gas becoming the explosion limit of CO was found as a result of experiments by the inventors to be from over 7 vol % to not more than 9 vol %. Accordingly, the concentration of oxygen in the exhaust gas is made not more than 7 vol %.

When oxygen decarburizing a melt in a vacuum refining vessel, there is the danger of the CO gas produced in the above way causing violent splashing of the metal and slag from the melt and boiling where the metal is splashed rapidly. Therefore, it is necessary to quickly lower the degree of vacuum after starting to blow oxygen and control the vacuum to a degree of vacuum able to avoid trouble in operation. Therefore, the vacuum control use pressure control valve 22 is opened to return the exhaust gas from the rear to the front of the vacuum pump to lower the degree of vacuum, but before the start of blowing oxygen, control of the degree of vacuum results in the vacuum control use pressure adjustment valve 22 becoming close to fully closed. With an automatic mode, it is difficult to rapidly open the vacuum control use pressure control valve 22 in opening degree. Therefore, by forcibly fixing the opening degree of the vacuum control use pressure adjustment valve 22 to at least 80% simultaneously with the signal for the start of blowing oxygen and increasing the return of the exhaust gas after the vacuum pump to the upper limit of the capacity of the adjustment valve, it becomes possible to quickly lower the degree of vacuum. If making the opening degree at least 80% from the general valve characteristics of a pressure adjustment valve, a flow rate of close to the fully open state flows, so here the opening degree was made at least 80%.

In the embodiment of FIG. 5, by fixing the opening degree of the pressure adjustment valve 22 to 100% for 50 seconds after the start of blowing oxygen to the inside of the refining vessel as shown in (c), it was possible to quickly return the degree of vacuum once raised to 152 Torr (20 kPa) to 300 Torr (40 kPa) in control. The degree of vacuum controlled to differs depending on the carbon concentration in the melt and the oxygen blow rate. Research of the inventors found that a range of 60 to 403 Torr (8 to 53 kPa) is suitable. Further, the time for fixing the vacuum control use pressure adjustment valve 22 to at least 80% after the start of blowing oxygen is determined by the degree of vacuum to be controlled to and the internal volume to be made a vacuum from the vacuum refining vessel to the vacuum exhaust unit. Experience of the inventors found that 30 seconds to 120 seconds was the optimal range. Accordingly, by fixing the opening degree of the vacuum control use pressure adjustment valve 22 to at least 80% for a predetermined time after the start of blowing oxygen to the inside of the refining vessel, it is possible to quickly control the degree of vacuum to a degree of vacuum of 60 to 403 Torr (8 to 53 kPa).

When vacuum oxygen decarburizing melt in the above way, it is necessary to lower the degree of vacuum to a certain extent (raise the pressure) for the oxygen decarburization to avoid splashing of the metal and slag and boiling. However, there is a suitable degree of vacuum determined by the carbon concentration in the melt and the oxygen blow rate. The lower the carbon concentration or the lower the oxygen blow rate, the more the danger of splashing or boiling of the metal can be avoided. On the other hand, the drop in the carbon concentration in the melt causes the oxidation loss of the iron and chromium to increase, so making the degree of vacuum rise as much as possible is preferable metallurgically for suppression of such oxidation loss. Therefore, the degree of vacuum is controlled so that when the carbon concentration of the melt is high, the degree of vacuum is lowered, while when the carbon concentration becomes low, the degree of vacuum is relatively raised. By this, it is possible to simultaneously satisfy the requirements of avoidance of upward boiling and boiling of the metal and reduction of the oxidation loss of the iron and chromium.

As embodiments of the present invention, control was performed by a degree of vacuum of 300 Torr (40 kPa) for a carbon concentration in the melt, by weight percent, of 0.60 to 0.40%, by a degree of vacuum of 205 Torr (27 kPa) for a carbon concentration in the melt of 0.40 to 0.25%, and by a degree of vacuum of 100 Torr (13 kPa) for a carbon concentration in the melt of 0.25 to 0.20%. These levels of degree of vacuum differ depending on the type of the steel being refined, the oxygen blow rate, the type and condition of the refining vessel, and other operating conditions and have to be determined so as to meet with local conditions. Further, successively reducing the oxygen blow rate, like the degree of vacuum controlled to, in accordance with the reduction in the carbon concentration in the melt is also effective operationally and metallurgically. The present invention has control of the degree of vacuum based on this as its scope. It is founded on successively controlling the degree of vacuum to the high vacuum side by the fall in the carbon concentration in the melt.

In the control of the degree of vacuum, in the method of successively switching the degree of vacuum to be controlled to a high vacuum along with a drop in the carbon concentration in the melt, it is preferable to switch to the higher vacuum quickly. Right before switching the degree of vacuum, however, experience shows that the drop in the flow rate of the exhaust gas causes the pressure adjustment valve 22 to close to fully close. With an automatic mode, it is difficult to rapidly close the pressure control valve in opening degree right after switching to a high vacuum. Therefore, at the same time as the switching signal to the higher vacuum, the opening degree of the pressure adjustment valve 22 is forcibly fixed to 0% to 20% and held for 60 seconds. The results are shown in (d) of FIG. 5. Due to this, exhaust gas no longer returns after the vacuum pump and the degree of vacuum can be quickly improved. However, here, "0%" means completely closing the pressure control valve 22. From the general valve characteristics of the pressure adjustment valve 22, when the opening degree becomes less than 20%, the valve becomes close to fully closed and has the characteristic of shutting off the fluid.

Therefore, the opening degree was made not more than 20%. Further, when switching the degree of vacuum to the high vacuum side, the time for fixing the opening degree of the vacuum control use pressure adjustment valve 22 to not more than 20% is determined by degree of vacuum to be controlled to and the inside volume etc. to be made a vacuum from the vacuum refining vessel to the vacuum exhaust unit. It is learned from experience that 30 seconds to 120 seconds is the optimum range.

The secondary materials, alloy iron, etc. are sometimes added to the vacuum refining vessel during control of the degree of vacuum. In this case, the secondary material, alloy iron, etc. to be added are stocked in advance in an intermediate hopper and are added to the vessel after making the intermediate hopper a degree of vacuum substantially the same as the inside of the furnace. Therefore, there should be almost effect on the flow rate of the exhaust gas at the time of addition. If however the secondary materials to be added include quicklime, gas components are produced such as the residual $CO_2$ in the quicklime or a sharp gas producing reaction is caused in the vessel due to the other alloys, secondary materials, etc. The gas produced here causes the flow rate of the exhaust gas to rapidly increase, so the opening degree of the pressure adjustment valve can no longer keep up and a rapid deterioration in the degree of vacuum (rise in pressure) is caused. Therefore, for 40 seconds after addition of the alloy, secondary materials, etc. inside the vessel, the opening degree of the pressure adjustment valve is fixed to 0% to positively suck in the exhaust gas. Due to this, the deterioration in the degree of vacuum due to the rapid increase in the flow rate of exhaust gas can be suppressed as shown in (e) of FIG. 5. However, here, "0%"means completely closing the pressure control valve. From the general valve characteristics of the pressure adjustment valve 22, when the opening degree becomes less than 20%, the valve becomes close to fully closed and has the characteristic of shutting off the fluid. Therefore, the pressure adjustment valve 22 is adjusted to return up to 10% of the flow of the exhaust gas to the upstream side of the water-sealed type vacuum pump 11 so as to improve the degree of vacuum inside the vacuum refining vessel quickly. If the flow rate of the returned exhaust gas exceeds 10%, however, the degree of vacuum will not be quickly improved, so this is made not more than 10%.

Further, the time for adjusting the opening degree of the pressure adjustment valve 22 for control of the degree of vacuum after addition of the alloy, secondary materials, etc. in the vessel and returning 10% of the flow rate of the exhaust gas is determined by the degree of vacuum to be controlled to, the capacity of the alloy addition hopper, the degree of vacuum inside the hopper, and the inside volume to be made a vacuum from the vacuum refining vessel to the vacuum exhaust unit. It is learned from experience that 30 seconds to 90 seconds is the optimum range.

The secondary materials, alloy iron, etc. added to the vacuum refining vessel normally have a cooling effect on the melt, so the melt temperature falls. Further, since addition is intermittent, the amounts of addition become certain considerable sizes and the melt temperature is temporarily greatly cooled. When the melt temperature falls, the oxygen efficiency for decarburization deteriorates metallurgically and the oxidation loss of the iron, chrome, etc. becomes larger. To suppress this, it is effective to raise the degree of vacuum and raise the oxygen efficiency for decarburization at the timing when the temperature temporarily drops. Therefore, even after the temporary increase in the flow rate of the exhaust gas quiets down after the addition of the secondary materials, alloy iron, etc. to the vacuum refining vessel, the opening degree of the pressure adjustment valve 22 continues to be fixed at 0% for 120 seconds so as to hold the degree of vacuum at a higher vacuum. Due to this, it becomes possible to suppress a drop in the decarburization reaction efficiency due to the drop in the melt temperature caused by the addition of the secondary materials and alloy. However, here, "0%" means completely closing the pressure control valve. From the general valve characteristics of the pressure adjustment valve 22, when the opening degree becomes less than 20%, the valve becomes close to fully closed and has the characteristic of shutting off the fluid. Therefore, the opening degree of the pressure adjustment valve 22 for control of the degree of vacuum is made 0 to 20%. Further, the time for making the opening degree of the pressure adjustment valve 22 for control of the degree of vacuum after addition of the alloy, secondary materials, etc. to the vessel less than 20% is determined by the degree of vacuum to be controlled to, the amount of addition of alloy, the carbon concentration in the melt, the concentrations of copper, nickel, and other alloy components in the melt, and the inside volume to be made a vacuum from the vacuum refining vessel to the vacuum exhaust unit. It is learned that 90 seconds to 240 seconds is the optimum range.

Figure 6:
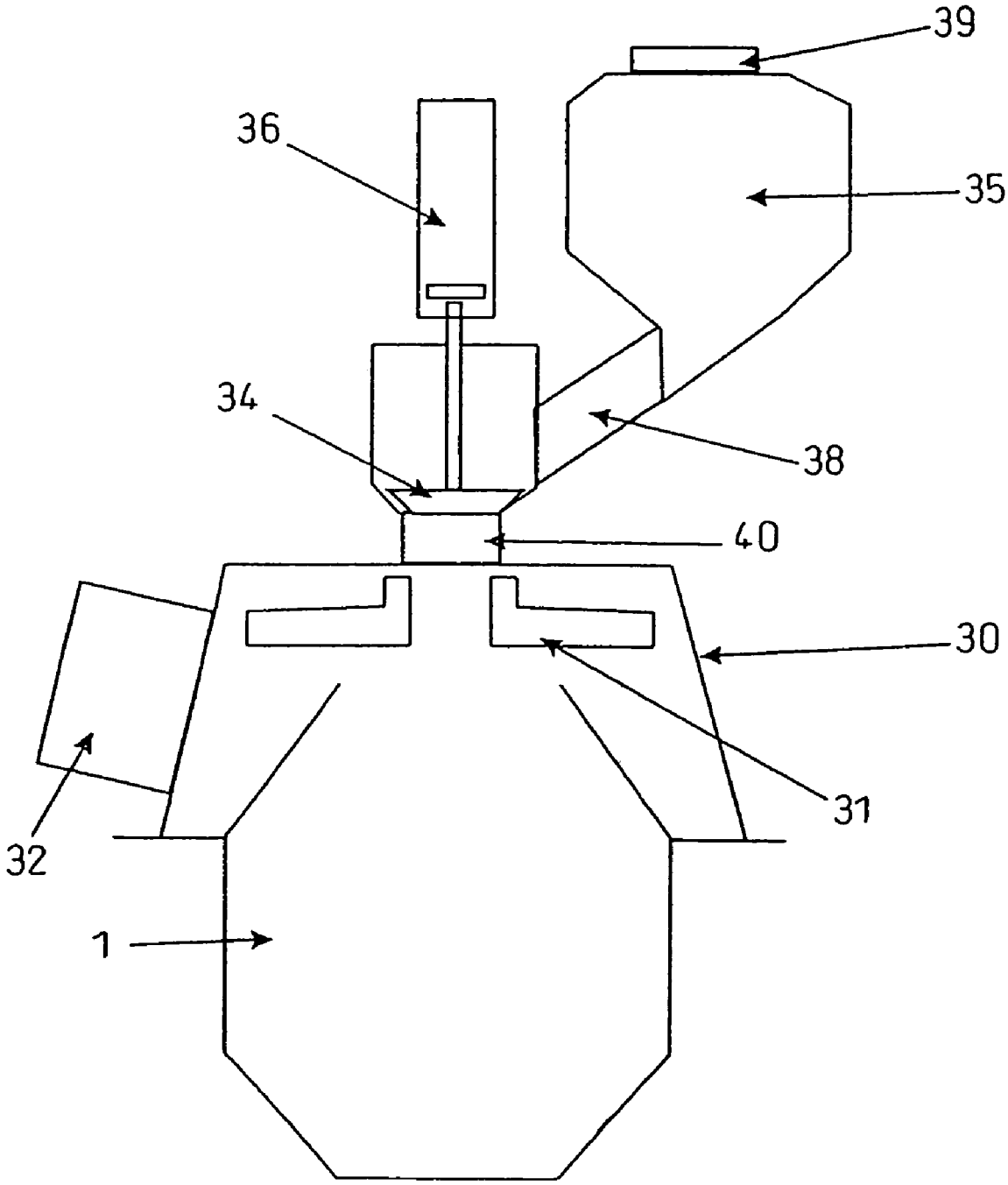
Fig. 6 PRIOR ART
FIG. 6 is a view schematically showing a seal unit in a conventional vacuum refining unit.
Figure 7:
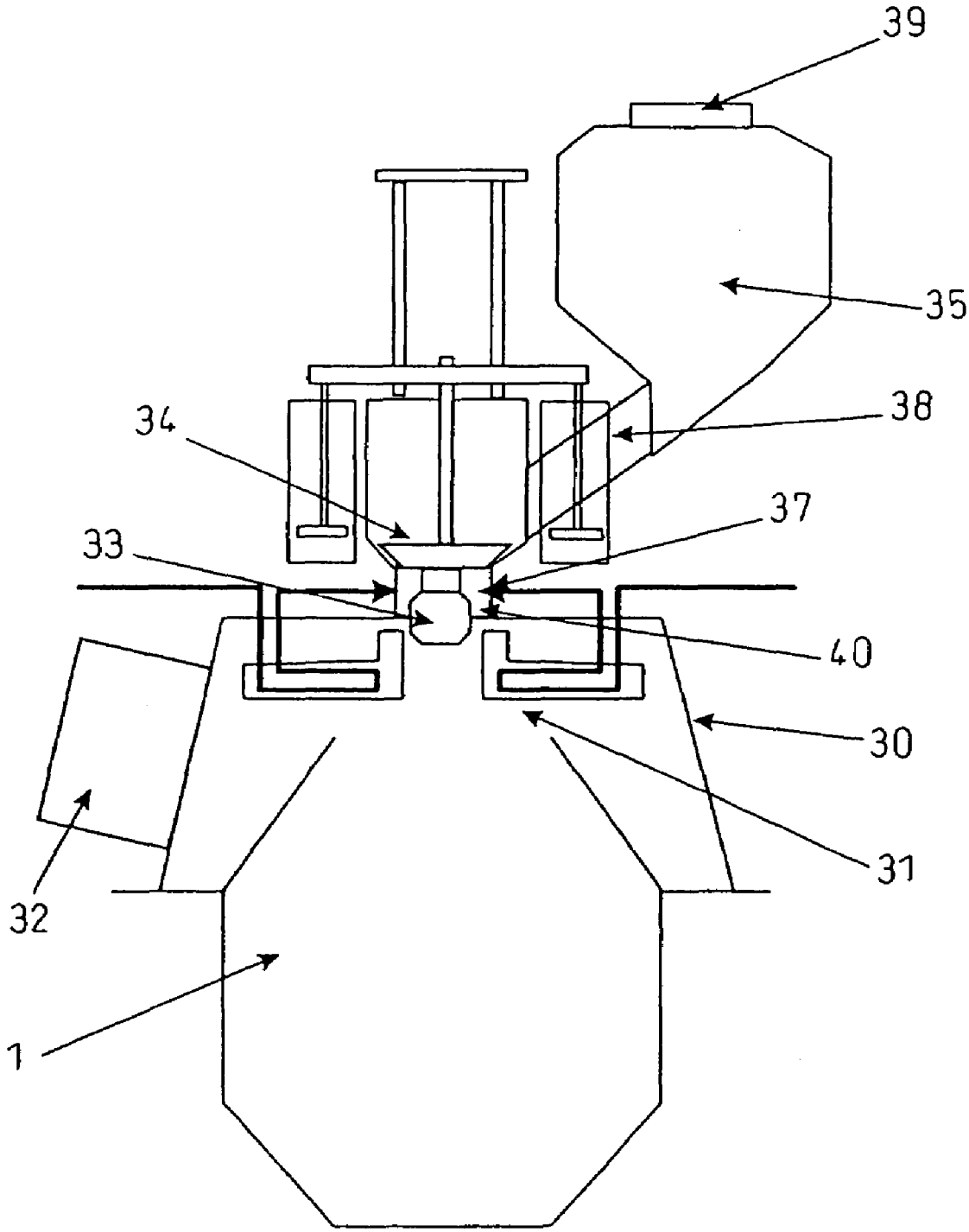
FIG. 7 is a view of an embodiment of a seal unit according to the present invention.

FIG. 6 and FIG. 7 schematically show one embodiment of a seal unit of the present invention. When vacuum decarburizing a melt in the vacuum refining vessel 1, the top of the furnace 1 is covered by a vacuum cover 30, while a middle cover 31 is arranged for preventing splashing of the metal and slag at the top of the space below the vacuum cover 30. However, the center of the middle cover 31 is formed with a large opening for adding the alloy and secondary materials. Normally, the upwardly blown metal directly reaches the alloy and secondary material addition port provided at the vacuum cover 30.

Therefore, in the present invention, a dummy lance 33 is provided as an integral structure with the valve body at the bottom of the bottom seal valve 34. Further, in the present invention, the inner walls of the alloy and secondary material addition port 40 are provided with a seal hole 37 for blowing seal gas (nitrogen) to the side walls of the dummy lance 33. The narrower the clearance between the side walls of the dummy lance 33 and the inner walls of the alloy and secondary material addition port 40, the greater the seal effect, but it is necessary to set the extent of the clearance while considering the lateral shaking at the time of elevation or descent of the bottom seal valve 34 and dummy lance 33 and unavoidable deposition of some metal. For example, it is preferable to set a clearance of 10 to 20 mm.

The bottom seal valve 34 and the dummy lance 33 normally are connected to an elevator unit arranged at the top (not shown in FIG. 6 and FIG. 7) and are raised or lowered through pneumatic pressure, oil pressure, or a winch through a sieve. If it were possible to keep the lateral shaking at the time of elevation or descent by the elevator unit smaller, it would be possible to further narrow the clearance between the side walls of the dummy lance 33 and the inside walls of the alloy and secondary material addition port 40 and enhance the seal effect.

To avoid interference with the alloy and secondary materials at the time of charging the alloy and secondary materials when elevating or lowering the bottom seal valve 34 provided with the dummy lance 33, the elevation stroke has to be made longer. That is, it is necessary to make it longer than the conventional elevation stroke by the amount of the height of the dummy lance 33.

Further, the space above the vacuum refining vessel 1 normally has a conveyor, hopper, or other equipment and apparatuses for conveying, charging, and storing the alloy, secondary materials, etc., a vacuum cover or vacuum duct for evacuating the vacuum refining vessel, and an elevator unit, ancillary units, etc. for the same arranged in it, so forms an extremely crowded space. Therefore, it is difficult to arrange an elevator unit with a long stroke there.

Therefore, in the present invention, as a means to deal with this, a pair of elevator units 36 (for example, air cylinders or hydraulic cylinders) are arranged at the two sides of the alloy and secondary material charging chute, a rod linked with the bottom seal valve is connected with the top of the connection bar of the elevator units, and this is pushed upward by the pair of elevator units 36 so as to raise or lower the valve body (bottom seal valve and dummy lance). Due to this means, it becomes possible to effectively use the crowded space above the vacuum refining vessel 1 and extend the elevation stroke of the bottom seal valve 34 with the dummy lance 33. In the present invention, the dummy lance 33 will not interfere with the alloy and secondary materials at the time of charging the alloy and secondary materials. On the other hand, when there is some leeway in the upper space, it is possible not to make the bottom seal valve and dummy lance an integral structure and to arrange the bottom seal valve in the intermediate vacuum hopper and set the dummy lance alone at the alloy and secondary material addition port. However, in this case, it is possible to maintain smooth charging of the alloy and sealability by raising and lowering the two linked together.

Further, in the present invention, to further raise the seal effect, the seal hole 37 for blowing seal gas (mainly nitrogen) to the dummy lance 33 is provided at the inside walls of the alloy and secondary material addition port 40.

The flow rate of the seal gas can be suitably controlled by a flow adjustment valve (not shown) in accordance with the refining conditions. In the period from the early to middle phase of the decarburization where the concentration in the melt is high and the oxygen blow rate is large, the splashing of the metal and slag is violent, so the flow rate of the seal gas is made larger. In the period from the middle to end phase of the decarburization where the splashing of the metal and slag is small, the flow rate of the seal gas is reduced. The low flow rate region of the seal gas at the end phase of the decarburization also contributes to improvement of the degree of vacuum in the furnace, so this advantageously promotes the metallurgical reaction and simultaneously is effective for reduction of the concentration of nitrogen in the melt.

Further, at the time of addition of the alloy and secondary materials, it is preferable to reduce the flow rate of the seal gas so that the alloy and secondary materials flow smoothly to the inside of the furnace. At this time, there is a concern that the metal and slag will enter the alloy and secondary material addition port 40 and deposit on the inside walls, but the alloy and secondary materials simultaneously pass through the addition port 40, so the entry of the metal and slag is not a problem at all.

On the other hand, the method of blowing seal gas includes, in addition to the above method, the method of introducing the gas from the outside through a dummy lance and rod of the bottom seal valve and blowing it out from a plurality of holes provided around the dummy lance to the inside walls of the alloy addition port 40. At the top of the space below the vacuum cover, the middle cover 31 is arranged to prevent splashing of the metal and slag, but the middle cover 31 is cooled by the inert gas (mainly nitrogen).

In the present invention, it is possible to utilize the above inert gas as the seal gas to be blown from the seal hole 37 toward the dummy lance 33. Normally, the gas cooling the metal core of the middle cover 31 is sent in the opposite direction as the supply route and discharged into the atmosphere, but the gas is high in temperature and the noise at the time of discharge of gas becomes a problem, so this has to be handled by complicated equipment and in the end the capital costs are slashed.

Further, in the present invention, it is possible to jointly use a supply source for the gas for cooling the metal core of the middle cover 31 and the seal gas blown from the seal hole (both mainly nitrogen), so it is possible to achieve a reduction of the gas cost.

Further, the gas (nitrogen) used for cooling the metal core of the middle cover 31 becomes high in gas temperature, so even if using the same amount as seal gas, the flow rate of the gas when discharged from the nozzle of the seal hole and passing through the clearance between the inside walls of the alloy and secondary material addition port 40 and the dummy lance 33 will become larger. As a result, entry of the metal and slag can be prevented more and the seal effect becomes larger.

When not using a middle cover 31, the seal gas is blown directly into the alloy addition port 40, but the method of laying a pipe to the inside of the high temperature exhaust gas duct for heat exchange, raising the seal gas temperature, and blowing the gas to the alloy addition port 40 so as to obtain the effect of a higher gas temperature and higher flow rate is also included in the present invention.

As the seal gas, mainly nitrogen is used, but the gas need only be inert. In addition to nitrogen, it is possible to use argon, $CO_2$, steam etc. alone. Further, it is possible to use a mixture of these gases.

The dummy lance is exposed to a high temperature, so it is preferable to make part of it out of refractories. Further, it may be cooled by water cooling, air cooling, etc. These methods are also included in the present invention.

Next, a water leakage detection unit in the refining apparatus of the present invention will be explained. The exhaust gas 15 produced in the vacuum refining furnace 1 passes through the water cooling duct 13, is sent to the gas cooler 16 connected to it, and is cooled there. After this, it passes from the gas cooler 16 through the duct 14, is sent to a dry type dust collector 9, then is further sent through the duct 14 to the vacuum exhaust unit 10, then is discharged to the atmosphere.

Here, by branching the exhaust gas suction conduit 24 for the humidity meter and analysis meter from a stage after the dust collector 9, part of the exhaust gas is branched off and introduced to the humidity meter 25. As a result, the humidity of the exhaust gas is measured at the humidity meter 25, but the exhaust gas analysis meter is also arranged at that position. The exhaust gas analysis meter is provided after the dust collector 9, but may also be provided after the gas cooler 16. Further, the analysis meter provided jointly here may be located at the same location in some cases, but may also be located separately from the humidity meter after the vacuum exhaust unit 10 or after the dust collector 9 in other cases.

The analysis meter is provided jointly so as to simultaneously measure at least one of the concentration or partial pressure of the CO, $CO_2$, $O_2$, $H_2$, or other gas when measuring the humidity of the exhaust gas. These analysis values are used to obtain a grasp of the state of progress of the reaction in the vacuum refining vessel or metallurgical furnace and used as operation guidance for blowing gas into the metallurgical furnace, charging the secondary materials and cooling material, etc. or used as information for judgment of the end of the metallurgical operation. Further, the measured value of the humidity meter may be utilized not only as information for judgment of water leakage, but also as information for judgment of the state of the reaction inside the vessel or inside the furnace.

Regarding the method of use of the apparatus, in treatment of the exhaust gas of the vacuum refining vessel 1, the high temperature exhaust gas produced is cooled by providing a gas cooler 16 in the middle of the ducts or water-cooling the middle part of the ducts. With the system of this means, the relative humidity of the exhaust gas is continually measured and monitored after the dust collector. For example, assume that during vacuum refining, the water pipes of the gas cooler 16 crack and cooling water sprays out into the exhaust gas. In this case, the water leakage is evaporated by the high temperature exhaust gas and the steam partial pressure of the exhaust gas rises, so the humidity meter 25 provided after later can detect the rise of the relative humidity. That is, the case where there is no water leakage inside the exhaust gas passage and a high humidity continues for a certain time with respect to the relative humidity of the exhaust gas in the normal state is judged as meaning the occurrence of water leakage and action is taken for the equipment and operation. Note that the invention is not limited to detection of just humidity. It is also possible to detect the steam partial pressure.

As a specific example of the measures for the equipment and operation, the necessary action for the repair work of the water leakage location, for example, when separating the metallurgical furnace and exhaust ducts or providing a bypass channel, changing the path to the bypass side, is taken immediately after detection of water leakage. Quick repair work for a water leakage location is important. Early detection of water leakage will enable the repair locations to be kept minor in most cases and enable the repair to be finished easily in a short time. Further, in some cases, it is possible to only issue a warning and suitably stop the operation of the equipment.

Normally, when separating part of the exhaust gas and measuring the humidity in the exhaust gas or analyzing and measuring the gas, the exhaust gas in the duct is sucked in by the suction pump and exhaust gas for analysis is directly supplied to the analysis meter. Accordingly, a single suction pump is enough. However, when measuring the humidity of the exhaust gas under a vacuum or analyzing and measuring the gas, two suction pumps have to be provided. The reasons for this will be explained below. When sucking in exhaust gas under a vacuum, the gas supplied to the analysis unit becomes a pressure corresponding to atmospheric pressure, so the absolute flow rate of the exhaust gas sucked from the vacuum by the same suction pump (flow rate of gas converted to standard state) will fluctuate greatly according to the degree of vacuum. That is, the absolute flow rate of the suction exhaust gas will become considerably small at the time of a high vacuum compared with the time of low vacuum. Accordingly, when using the same suction pump, the flow rate of gas supplied to the humidity meter or gas analysis and measurement will fluctuate greatly depending on the degree of vacuum. On the other hand, to maintain the measurement precision of the humidity measuring unit or gas analyzer, the fluctuation in the flow rate of gas supplied to these meters must be avoided. As a means for this, two suction pumps are provided.

Note that the steam partial pressure of the exhaust gas during vacuum refining rises due to reasons other than water leakage of the equipment in some cases. The vacuum refining vessel is charged with the alloy iron, cooling material, quicklime, and other secondary materials during operation. These secondary materials contain some moisture, so after charging, the steam partial pressure in the exhaust gas temporarily rises. In particular, the quicklime and other secondary materials easily absorb moisture and have large moisture contents, so the amount of generation of steam after charging remarkably rises. Accordingly, if hastily judging a rise in relative humidity to mean water leakage, the result will be erroneous detection. Therefore, the inventors investigated in detail the behavior of the relative humidity and as a result found the rise in humidity due to water leakage becomes continuous. While there is some fluctuation, once the humidity rises, it continues in a high state until the end of the treatment. On the other hand, it was learned that the rise in humidity due to the addition of the alloy, cooling material, secondary materials, etc. into the refining vessel is short term and when a certain time elapses after charging, the humidity falls to the precharging level. Therefore, it is possible to utilize the difference in behavior of the humidity level to judge if there is water leakage from the cooling water system.

Further, as other reasons for the rise in humidity in the exhaust gas other than water leakage, sometimes the gas fuel, solid fuel, etc. containing hydrocarbons is burned for the purpose of providing the heat source at the time of refining in the refining vessel. For example, if burning LNG, LPG, kerosine, or another hydrocarbon-based fuel in the vessel, a large amount of steam enters the exhaust gas. However, the timing of supply and the amount of supply become clear and the amount of entry of steam into the exhaust gas can be estimated with relatively good precision. Therefore, it is sufficiently possible to separate these effects from the results of measurement of the partial pressure of steam in the exhaust gas.

Specifically, to judge water leakage, it is sufficient to find in advance and similarly set the continuous time of humidity rise after charging from the advance settings of the rate of change of humidity and the humidity levels thereof and the types and amounts of the alloy, cooling material, secondary material, or other components added to the inside of the vessel at those times, further set in advance the humidity rise estimated from the time of supply and amount of supply of the hydrocarbon-containing fuel, and judge there is water leakage and automatically output a warning signal or control signal when the settings of the continuous humidity and time of humidity rise exceed the set humidity level pattern) and time level.

Next, the gas ventilation unit and the water-sealed cover of the return water storage tank in the refining apparatus of the present invention will be explained.

The exhaust gas produced in the vacuum refining vessel 1 is cooled by the exhaust gas cooler 16, cleaned by the dust collector 9, and introduced into the multiple-stage ejector type vacuum exhaust unit. The multiple-stage vacuum exhaust unit performs first suction by the No. 1 ejector, condenses the steam at the later No. 1 condenser and repeats the suction and steam condensation at the No. 2 ejector and No. 2 condenser. Finally, the gas is sucked in by the water-sealed type vacuum pump 11, then passes through the separator tank and is discharged into the atmosphere.

Here, the condenser water from the nos. 1 and 2 condensers, the sealing water from the water-sealed type vacuum pump, and the cooling water from the separator tank pass through the pipe 26 and are collected at the water storage tank constituted by the hot well 27. The cooling water of the hot well 27 is managed in level in the tank by a water level meter. When rising a certain water level or more, the return pump 28 is started up and the water is returned from the hot well 27 to the cooling tower 29 through the return pipe. The cooling water cooled at the cooling tower passes through the feed pipe from the feed pump 30 and is sent to the condensers, water-sealed pump, etc. As explained above, normally the feed pump belongs to a different power source system than the return pump of the hot well.

Figure 8:
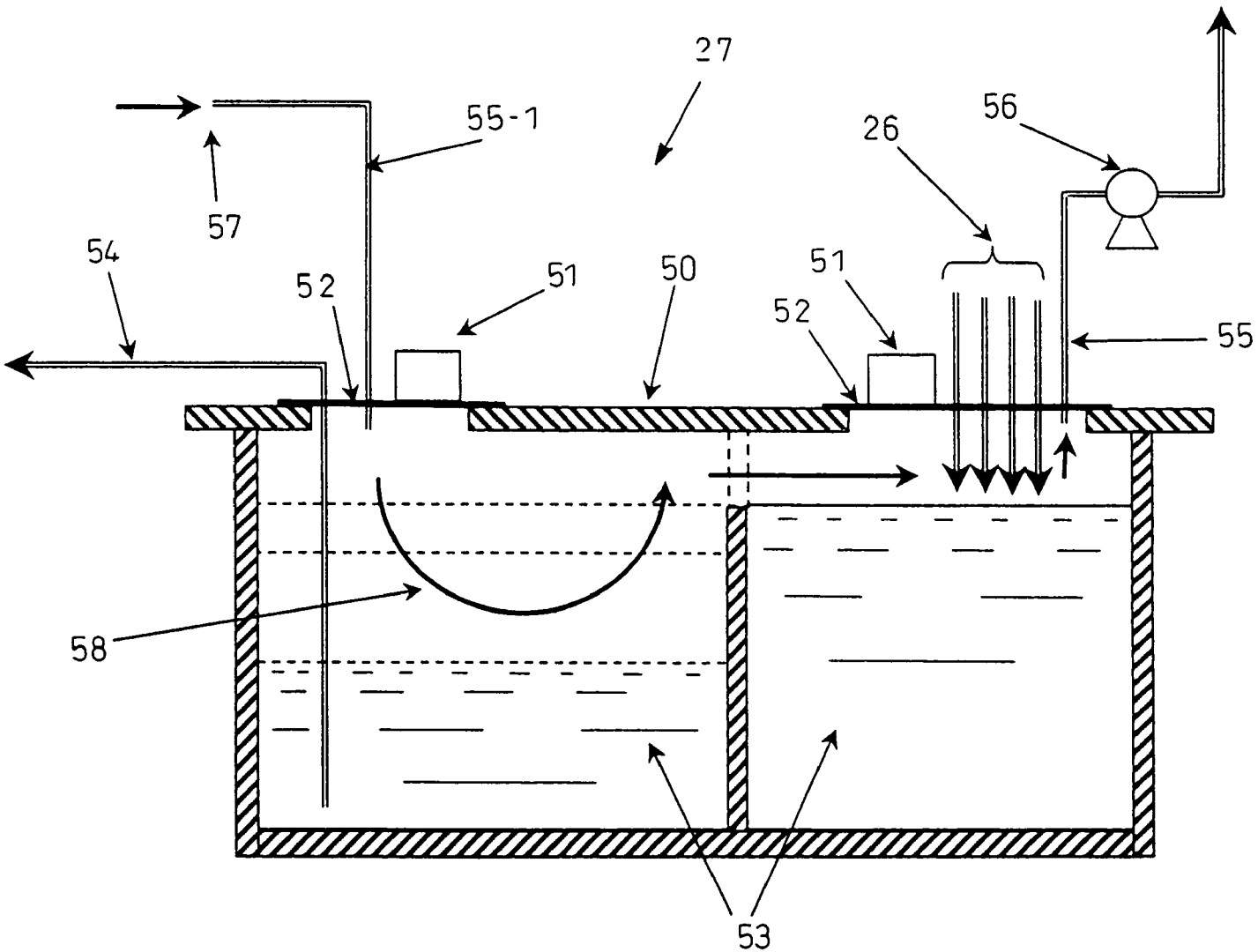
FIG. 8 is a view schematically showing the area around a hot well.

A detailed example of the area around the hot well 27 will be shown schematically in FIG. 8. The hot well 27 is a concrete structure for storing condenser water and sealing water of the water-sealed pump etc. The top is clad by iron plate 52 at several locations other than the concrete 50. The condenser water and the cooling water flowing in from the water-sealed pump sealing water pipe 26 are temporarily stored in water 53 stored in the hot well. A supply pump is started up in accordance with the level of the stored water at the left side of the figure to send the water through the feed pipe 54 to the cooling tower 29.

In the prior art, as explained above, the condenser water and sealing water of the water-sealed pump are accompanied with gas bubbles containing CO so the CO concentration in the hot well rises. Further, during the vacuum refining time, the flow rate of the cooling water greatly changes. Along with this, the inside of the hot well changes between positive pressure and negative pressure. When becoming positive pressure, gas containing CO will leak out from the joints of the top concrete and the iron plate resulting in an extremely danger state of CO poisoning in the surroundings.

Therefore, the practice is to provide an exhaust duct 55 and ventilate the inside of the hot well by an exhaust blower 56 from the exhaust outlet port. However, with just exhaust, the inside of the hot well will become a negative pressure, the above-mentioned seal parts will break, the clearance will expand, and air will be sucked in. Normally, this is not a problem, but when the exhaust blower stops due to a breakdown or blackout, CO will leak out from the seal parts with the large clearance of the hot well resulting in a dangerous situation.

Therefore, the inventors discovered that by evacuating gas from the exhaust duct connected to the top of the hot well using a suction means and guiding the ventilation gas from the suction duct of the ventilation gas connected to the top of the hot well to the inside of the return water storage tank, it is possible to reduce the negative pressure inside the hot well and possible to almost completely eliminate damage to seal parts between the concrete and iron plate part.

Specifically, this is achieved by placing the exhaust duct 55 at the top of the hot well, evacuating the inside of the hot well by an exhaust blower 56 serving as the suction means, placing an exhaust gas duct 55-1 at the top of the hot well, causing air to flow from the ventilation gas introduction port 57, and positively ventilating the inside of the hot well. Here, as the ventilation gas, it is preferable to use air from the viewpoint of cost and the viewpoint of safety.

For example, a ventilating flow occurs in the tank as shown by the flow 58 of the ventilation gas. The inside of the hot well becomes an air atmosphere while the CO-containing gas is sucked out. Further, the negative pressure inside the hot well becomes smaller than the air flowing in from the duct. It becomes possible to almost completely eliminate damage to the seals between the rear concrete and the iron plate part.

Further, the inventors conducted a detailed survey on the inner pressure inside a hot well in relation to vacuum refining operations and as a result found that, as explained above, the inside of a hot well not only becomes a negative pressure, but also becomes a positive pressure or a negative pressure. For example, as an operation before starting the vacuum operation, there is the method of operation of closing the vacuum valve 23 of FIG. 4, evacuating the space from the dust collector 9 to the vacuum pump 11 using the water-sealed type vacuum pump 11 in advance (hereinafter referred to as "prevacuum treatment") and, simultaneous with the start of operation, opening the vacuum valve 23 and evacuating the vacuum refining vessel side. At this time, the degree of vacuum of the prevacuum treatment side rapidly deteriorates (for example, falls from $1.33\times10^4$ Pa to $6.67\times10^4$ Pa), so the condenser water rapidly flows into the hot well and, while for a short time, the gas inside the hot well is compressed resulting in a large positive pressure. A survey by the applicant revealed that $1.96\times10^3$ Pa or more was reached in many heats. Accordingly, even if sucking out gas by an exhaust blower, at this timing, the inside of the hot well cannot be held at a negative pressure. However, with the method of the present invention, damage to the seal parts is small, so the amount of leakage of the gas can be kept small. Further, the inside of the hot well is positively replaced with air, so even if the inside of the hot well becomes a positive pressure and a small amount of gas leaks out, the CO gas contained can be kept to a level not causing any health problems.

Figure 9:
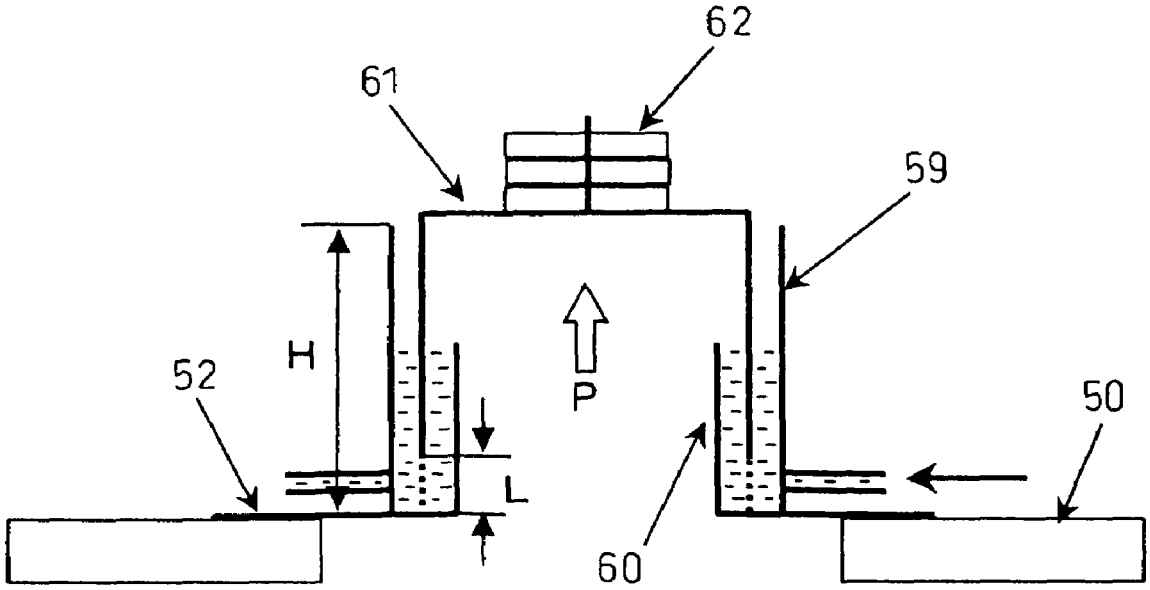
FIG. 9 is a view of a side view of a hot well water-sealed cover.

FIG. 9 illustrates the case of providing two water-sealed covers 51 (side view).

The water-sealed cover 51 provided at the top of the hot well is comprised of a double tube shaped cylindrical vessel having an outer tube 59 and an inner tube 60 on an iron plate 52 of the top of the hot well and a partition plate 61 able to be inserted in between the inner and outer tubes. In accordance with need, a weight 62 is used for increasing the weight of the partition cover. However, since the weight of the partition cover alone is usually not enough to withstand the gas pressure in the hot well, the weight is normally preferably usually used.

Specifically, the inner tube 59 is lower than the outer tube 60. In the state with the partition cover 61 inserted, the water-sealed cover sealing water is supplied from the outside of the outer tube 60. Water is continuously supplied so that the sealing water enters the inner tube side from the outer tube side of the partition cover and overflows from the top end of the inner tube, travels along the inside walls of the inner tube, and flows into the hot well.

The sealing water height is designed so that at the time of a normal vacuum refining operation, due to the sealing water, the gas inside the hot well will not leak to the outside and the sealing water will not be cut off even with pressure fluctuations of positive pressure and negative pressure of the gas in the hot well. If however the water inside the hot well overflows and is filled to the inside of the water-sealed cover due to some reason or another as explained above, the rise in the water level will cause the partition cover 61 to be lifted up and water to leak to the outside from the clearance between the inner and outer tubes. Due to this, it is possible to greatly ease the force acting on the connecting parts of the iron plate and concrete at the top of the hot well and damage to the seal parts can be kept extremely minor.

The size and number of the water-sealed covers placed in the hot well may be suitably set in accordance with the total amount of water of the condenser water supplied, the sealing water for the water sealed pump, etc. For example, if the total amount of water is 600 t/h or so, provision of two water-sealed covers of cylindrical shapes of diameters of 500 mm for allowing the overflowing water to escape to the outside may be mentioned as a common sense embodiment.

Next, a preferable range of settings of the weight of the partition cover will be explained. The pressure inside the hot well, as explained above, sometimes reaches more than $1.96\times10^3$ Pa. As pressure, this is small, but if this pressure acts on an area of a certain size, it becomes a large pressure. Explaining this using the above-mentioned water-sealed cover, the cover is a cylindrical shape of a diameter of 500 mm, so if a pressure of $1.96\times10^3$ Pa acts on it, a force of about 40 kg will act pushing up the partition cover 61. Therefore, if the weight of the partition cover is 10 kg, it will be necessary to adjust the weight by adding a weight of 30 to bring it over 40 kg. Accordingly, the weight of the cover portion of the water-sealed cover constituted by the partition cover 61 and the weight 62, if generalized, must satisfy the following formula (1):

$$(W1+W2)\times 9.8>P\times S \quad (1)$$

where,

W1: weight of partition cover (kg)

W2: weight of weight placed on partition cover (kg)

P: maximum gas pressure acting inside return water storage tank (Pa)

S: maximum area of projection of inside surface of movable partition cover on horizontal plane ($m^2$)

In FIG. 9, W1+W2 is the total weight of the movable partition cover 61 and the weight 62, P is the maximum gas pressure in the hot well, and S is the horizontal projected area of the partition cover 61.

Next, the preferable water-sealing height of the partition cover will be explained. The pressure inside the hot well, as explained above, sometimes reaches over $1.96\times10^3$ Pa. Therefore, it is necessary to secure a certain extent of water-sealing height so that the water seal is not broken and gas does not leak to the outside.

For example, in FIG. 9, if assuming that a pressure P of $1.96\times10^3$ Pa acts on the inside, the outside water level of the side walls of the partition cover 61 would become about 200 mm higher than the inside water wall. Therefore, the height H of the outer tube 59 at the outside of the partition cover side walls has to be over (200+L) mm considering the sealing water passage height Lmm connecting the inside and outside of the partition cover.

Accordingly, the water-sealing height of the water-sealed cover, if generalized, must satisfy the following formula (2):

$$H-L>9.8\times10^3\times P \quad (2)$$

where,

H: height of outside outer tube of partition cover side wall of water-sealed cover (m)

P: maximum gas pressure acting at inside of return water storage tank (Pa)

L: height of sealing water passage between inner tube and outer tube in water-sealed cover (m)

EXAMPLES

The present invention was applied when producing SUS304 stainless steel (8 wt % nickel and 18 wt % chromium) in a 60 ton melt AOD furnace as shown in FIG. 1. In atmospheric pressure refining, bottom blowing is performed in the state shown in FIG. 1(*b*) and, in accordance with need, top blowing is jointly used. In vacuum refining, bottom blowing is performed after reducing the pressure inside the refining vessel in the state shown in FIG. 1(*a*). The concentration of carbon in the melt at the time of start of production is about 1.6%. Decarburization refining is performed until a carbon concentration of 0.04%, then the pressure inside the vessel is returned to atmospheric pressure while adding Fe—Si alloy iron as a reducing agent for reducing the chromium oxidized during the decarburization and only argon gas is blown in for reduction. The steel was taken out to a ladle.

Example 1

The pattern shown in Table 1 was used for refining. The first step was made atmospheric pressure refining with top and bottom blowing and use of oxygen gas alone as the bottom blown gas. A concentration of carbon of 0.5% to 0.15% was made the second step. The pressure inside the vessel in the second step was made a two-stage pressure of 350 Torr (46 kPa) and 250 Torr (33 kPa), the blow rates of the bottom blown gas were made 0.9 and 0.5 $Nm^3$/min, and the blown gas was made oxygen gas alone. The third step was made decarburization refining until a concentration of carbon of 0.04% at a pressure inside the vessel of a two-stage pressure of 100 Torr (13 kPa) and 40 Torr (5 kPa) and a blow rate of bottom blown gas held at 0.5 $Nm^3$/min.

At the first step, the oxygen gas is blown in alone until the concentration of carbon reaches 0.5%, so while the oxygen efficiency for decarburization falls somewhat and the oxidation of chromium increases, it was possible to slash the amount of use of the expensive argon gas. Note that in the region of the concentration of carbon of 0.7 to 0.5% of the first step, if making the ratio of the bottom blown gas $O_2$/argon not 1/0, but 4/1, while the amount of use of the expensive argon gas increases, the oxygen efficiency for decarburization at the carbon region can be improved.

At the second step, the blow rate of the bottom blown gas was raised to 0.9 to 0.5 $Nm^3$/min so as to make the pressure inside the vessel rise to 350 (46 kPa) to 250 Torr (33 kPa) while maintaining the oxygen efficiency for decarburization. As a result, it was possible to realize a reduction in the dust generation and a shorter refining time.

At the third step as well, the pressure inside the vessel was made 100 Torr (13 kPa) and the blow rate of bottom blown gas was maintained at 0.5 $Nm^3$/min under conditions of 40 Torr (5 kPa), whereby it was possible to maintain the high oxygen efficiency for decarburization and contribute to a shorter refining time.

TABLE 1

| | Decarburization phase Step | | | | | |
|---|---|---|---|---|---|---|
| Class | First step Atmospheric pressure | Second step Vacuum | | Third step Vacuum | | Reduction phase |
| Pressure (Torr) | 760 (100 kPa) | 350 (45 kPa) | 250 (33 kPa) | 100 (13 kPa) | 40 (5 kPa) | 760 (100 kPa) |
| Blow rate of bottom blown gas ($Nm^3$/min/t) | 1.4 1.2 | 0.9 | 0.5 | 0.5 | 0.5 | 0.5 |

TABLE 1-continued

| Class | Decarburization phase Step: First step Atmospheric pressure | | Second step Vacuum | | Third step Vacuum | | Reduction phase |
|---|---|---|---|---|---|---|---|
| $O_2$/argon ratio of bottom blown gas | 1/0 | 1/0 | 1/0 | 1/0 | 1/5 | 0/1 | 0/1 |
| Blow rate of top blown gas ($Nm^3$/min/t) | 1.4 | 1.0 | 0.0 | 0.0 | 0.0 | 0.0 | 0.0 |
| Carbon concentration (%) | 1.6 | 0.7 | 0.5 | 0.25 | 0.15 | 0.08 | 0.04 |

Comparative Example 1

The pattern shown in Table 2 was employed for refining. Atmospheric pressure refining was performed for a concentration of carbon of 1.6 to 0.4% and vacuum refining was performed for a concentration of carbon of 0.4% and less. The refining conditions at the atmospheric pressure refining were similar to those of the first step of Example 1. The blow rate of the bottom blown gas in the vacuum refining was made 0.3 $Nm^3$/min like the conventional level. Since the blow rate of the bottom blown gas was low, from the viewpoint of preventing a drop in the oxygen efficiency for decarburization and preventing an increase in the dust generation, the pressure inside the vessel was made a maximum of 150 Torr (20 kPa).

Since the blow rate of the bottom blown gas was overwhelmingly lower than the above example of the present invention, the refining time was greatly prolonged. Compared with Example 1, the vacuum refining time was about 2.5 times longer and the overall refining time required was also about 1.8 times longer. Therefore, continuous casting for continuously casting charges in a continuous casting process became impossible.

TABLE 2

| Class | Decarburization phase Step: First step Atmospheric pressure | | Second step Vacuum | | Third step Vacuum | | Reduction phase |
|---|---|---|---|---|---|---|---|
| Pressure (Torr) | 760 (100 kPa) | | 150 (20 kPa) | 150 (20 kPa) | 100 (13 kPa) | 40 (5 kPa) | 760 (100 kPa) |
| Blow rate of bottom blown gas ($Nm^3$/min/t) | 1.4 | 1.2 | 0.3 | 0.3 | 0.3 | 0.3 | 0.5 |
| $O_2$/argon ratio of bottom blown gas | 1/0 | 1/0 | 1/0 | 1/0 | 1/5 | 0/1 | 0/1 |
| Blow rate of top blown gas ($Nm^3$/min/t) | 1.4 | 1.0 | 0.0 | 0.0 | 0.0 | 0.0 | 0.0 |
| Carbon concentration (%) | 1.6 | 0.7 | 0.4 | 0.25 | 0.15 | 0.08 | 0.04 |

Example 2

In the first vacuum refining, the pressure was restored to atmospheric pressure once when the decarburization progressed to a concentration of carbon of 0.08%, then the vessel was again evacuated and decarburization refining was performed until the target concentration of carbon. The blow rate of the bottom blown gas in the vacuum refining was made 0.5 $Nm^3$/min per ton melt. Table 3 shows the results of the present invention.

In a comparative example, vacuum refining was performed continuously until reaching the target concentration of carbon. The blow rate of the bottom blown gas in the vacuum refining was made 0.5 $Nm^3$/min per ton melt in the same way as the example of the present invention until a concentration of carbon of 0.15%. In a region of concentration of carbon lower than this, it was made 0.3 $Nm^3$/min per ton melt in the same way as in the past. Table 4 shows the results of the comparative example.

TABLE 3

| Class | Decarburization phase: Atmospheric pressure | | Vacuum | | Restored pressure | Vacuum | | Reduction phase |
|---|---|---|---|---|---|---|---|---|
| Pressure (Torr) | 760 (100 kPa) | | 200 (26 kPa) | 150 (20 kPa) | 760 (100 kPa) | 100 (13 kPa) | 50 (7 kPa) | 760 (100 kPa) |
| Blow rate of bottom blown gas ($Nm^3$/min/t) | 1.4 | 1.2 | 0.5 | 0.5 | 0.3 | 0.5 | | 0.3 |
| $O_2$ ratio of bottom blown gas | 100 | 100 | 100 | 100 | 0 | 20 | | 0 |
| Blow rate of top blown gas ($Nm^3$/min/t) | 1.4 | 1.0 | 0.0 | 0.0 | 0.0 | 0.0 | | 0.0 |
| Treatment time (min) | 10.5 | | 11.5 | | 3.0 | 5.0 | | 5.0 |
| Carbon concentration (%) | 1.6 | 0.7 | 0.5 | 0.25 | 0.08 | | | 0.01 |

TABLE 4

| Class | Decarburization phase: Atmospheric pressure | | Vacuum | | | | Reduction phase |
|---|---|---|---|---|---|---|---|
| Pressure (Torr) | 760 (100 kPa) | | 200 (26 kPa) | 150 (20 kPa) | 100 (13 kPa) | 40 (5 kPa) | 760 (100 kPa) |
| Blow rate of bottom blown gas ($Nm^3$/min/t) | 1.4 | 1.2 | 0.5 | 0.5 | 0.3 | 0.3 | 0.3 |
| $O_2$ ratio of bottom blown gas | 100 | 100 | 100 | 100 | 100 | 0 | 0 |
| Blow rate of top blown gas ($Nm^3$/min/t) | 1.4 | 1.0 | 0.0 | 0.0 | 0.0 | 0.0 | 0.0 |
| Treatment time (min) | 10.5 | | | 12.5 | | 21.0 | 5.0 |
| Carbon concentration (%) | 1.6 | 0.7 | 0.5 | 0.25 | 0.15 | 0.08 | 0.01 |

In the comparative example shown in Table 4, decarburization refining from a concentration of carbon of 0.08% to 0.01% required 21 minutes of time. On the other hand, in the present invention shown in Table 3, decarburization refining from a concentration of carbon of 0.08% to 0.01% was completed in 8 minutes combining the pressure restoration time and the evacuation time. That is, when refining ultra-low carbon chromium-contained molten steel of a concentration of carbon of a target 0.01%, when using the present invention, it was possible to shorten the refining time by as much as 13 minutes compared with the past.

As a result of being able to shorten the decarburization refining time, it was possible to obtain the effects of slashing the inert gas prime units, slashing the refractory prime units due to prolongation of the lifetime of the refining vessel, slashing the steam prime units used for the vacuum exhaust steam ejectors, reducing the heat loss due to long refining, etc. Further, with the method of the present invention, it is possible to produce even ultra-low carbon steel without greatly prolonging the production time compared with ordinary concentration of carbon steel and therefore continuous casting in a continuous casting process became possible.

INDUSTRIAL APPLICABILITY

The present invention enables forcible agitation of melt in the medium carbon region, in particular in the region of a carbon concentration of 0.2 to 0.5%, in vacuum refining of chromium-contained molten steel so as to enable vacuum refining of a high oxygen efficiency for decarburization at a pressure of 250 to 400 Torr (33 to 53 kPa). As a result, generation of dust can be suppressed and further an increase in the blow rate of the bottom blown gas can be achieved, so the refining time can be shortened.

The present invention further enables selection of a higher pressure as the atmosphere in the refining vessel even in the carbon region higher than the carbon region where the vacuum operation of 250 to 400 Torr (33 to 53 kPa) is performed so as to enable use of a vacuum operation rather than an atmospheric pressure operation and thereby enable the amount of use of the expensive inert gas to be slashed and the productivity to be improved.

The present invention further enables adoption of two-stage vacuum treatment comprising performing decarburization refining of ultra-low carbon chromium-contained molten steel in an AOD vacuum refining furnace where the pressure inside the vessel is made to rise once in a state where the decarburization has progressed to a certain extent in the refining under a vacuum, then again lowering the pressure and resuming the refining under a vacuum and a great increase in the blow rate of the bottom blown gas compared with the past so as to realize a great improvement in the decarburization rate in the low carbon region and a great reduction in the overall decarburization refining time. As a result, it becomes possible to inexpensively and easily produce ultra-low carbon chromium steel having a concentration of carbon of not more than 0.01 wt %.

Further, the present invention establishes a vacuum exhaust unit and control method enabling control of the degree of vacuum inside a vacuum refining furnace or its ducts for oxygen decarburization refining of a melt under a vacuum. The effects in equipment and operation obtained due to this are as follows:

First, a shorter overall vacuum treatment time can be achieved, the productivity can be improved, and the refractory lifetime of the vacuum refining furnace can be improved.

Second, splashing of the metal and slag during the vacuum oxygen refining, boiling of the metal, etc. can be effectively prevented and prevention of blockage of the alloy addition port, prevention of deposition of metal on the top cover, prevention of blockage of the vacuum exhaust ducts, etc. can be achieved. Due to this, the idling time of equipment is greatly shortened and slashing of the maintenance costs and improvement of the operating productivity can be achieved.

Further, the present invention enables sufficient sealing at an alloy and secondary material addition port in the refining process without trouble caused by splashing of the metal and slag, so it is possible to greatly slash the prime units of the materials and secondary materials, possible to shorten the operating time, and possible to greatly reduce the operating costs.

Further, the present invention can measure and monitor the humidity of exhaust gas so as to detect a small amount of water leakage inside the exhaust gas passage and thereby detect water leakage early and simultaneously strikingly improve the reliability of detection of water leakage.

The present invention enables the provision of a method and apparatus simply dealing with the issues in hot wells, that is, the leakage of Co-containing gas from the hot well and suppression of damage to equipment at the time of occurrence of overflow of cooling water in the hot well.

The invention claimed is:

1. A refining apparatus for a chromium-contained molten steel, said refining apparatus for a chromium-contained molten steel characterized by comprising a vacuum refining vessel, an alloy and sub-material addition unit provided above the vacuum refining vessel, exhaust gas cooler, vacuum valve, one-stage or multiple-stage ejector type vacuum exhaust unit, and water-sealed type vacuum pump arranged successively and by having a pressure control valve under vacuum for returning part of the exhaust gas from down stream side of said water-sealed type vacuum pump to the upstream side of said water-sealed type vacuum pump.

2. A refining apparatus for a chromium-contained molten steel as set forth in claim 1, characterized by being provided with a means for adjusting the opening degree of said vacuum control use pressure adjusting valve to control the degree of vacuum inside said vacuum refining vessel to return part of the exhaust gas exhausted from said water-sealed type vacuum pump to the upstream side of the exhaust gas passage of said water-sealed type vacuum pump.

3. A refining apparatus for a chromium-contained molten steel as set forth in claim 1, characterized by providing a means arranging a vacuum valve between an exhaust side of said one-stage or multiple-stage ejector type vacuum exhaust unit and said water-sealed type vacuum pump and said vacuum refining vessel side of said exhaust gas cooler, closing said vacuum valve before the start of vacuum refining to place said ejector type vacuum exhaust unit and said water-sealed type vacuum pump in a vacuum state in advance, and opening said vacuum valve simultaneously with the start of vacuum refining to raise the degree of vacuum of the vacuum refining vessel.

4. A refining apparatus for a chromium-contained molten steel as set forth in claim 1, characterized by providing a means for adjusting the opening degree of said vacuum control use pressure control valve under a vacuum in advance to restore up to 10% of the flow of exhaust gas to the upstream side of said water-sealed type vacuum pump and then immediately adjusting the degree of vacuum in said vacuum refining vessel when adding alloy and sub-material during refining under a vacuum in the vacuum refining vessel.

5. A refining apparatus for a chromium-contained molten steel as set forth in claim 1, characterized by providing a seal unit having a seal valve for sealing an addition port at the bottom of said alloy and secondary material adding unit and setting a dummy lance integrally with said seal unit at the bottom of said seal valve or setting it elevatably linked with said seal unit.

6. A refining apparatus for a chromium-contained molten steel as set forth in claim 5, characterized by providing a seal port for blowing seal gas to a clearance between inside walls of the addition port of said alloy and secondary material unit and said dummy lance.

7. A refining apparatus for a chromium-contained molten steel as set forth in claim 1, characterized by providing a center cover having a cooling function at the bottom of said alloy and secondary material addition unit.

8. A refining apparatus for a chromium-contained molten steel as set forth in claim 1, characterized by providing at the back of said exhaust gas cooler inside the refining apparatus system a water leakage detection unit able to detect water leakage by measuring at least one of a steam temperature or steam pressure in the exhaust gas.

9. A refining apparatus for a chromium-contained molten steel as set forth in claim 1, characterized by arranging at the back of said one-stage or multiple-stage ejector type vacuum exhaust unit and said water-sealed type vacuum pump a return water storage tank linked with these and attached to a gas ventilation unit.

10. A refining apparatus for a chromium-contained molten steel as set forth in claim 9, characterized by providing a water-sealed cover having a partition cover provided, without being fixed, at the top of said return water storage tank.

11. A refining apparatus for a chromium-contained molten steel as set forth in claim 10, characterized in that the weight of said water-sealed cover satisfies the following formula (1):

$$(W1+W2)\times 9.8>P\times S \quad (1)$$

where,

W1: weight of partition cover (kg)

W2: weight of weight placed on partition cover (kg)

P: maximum gas pressure acting inside return water storage tank (Pa)

S: maximum area of projection of inside surface of movable partition cover on horizontal plane ($m^2$).

12. A refining apparatus for a chromium-contained molten steel as set forth in claim 10, characterized in that the water-sealing height of said water-sealed cover satisfies the following formula:

$$H-L>9.8\times 10^3\times P \quad (2)$$

where,

H: height of outside outer tube of partition cover side walls of water-sealed cover (m)

P: maximum gas pressure acting at inside of return water storage tank (Pa)

L: height of sealing water passage between inner tube and outer tube in water-sealed cover (m).

* * * * *